US011702244B2

(12) United States Patent
Rickabaugh

(10) Patent No.: US 11,702,244 B2
(45) **Date of Patent: *Jul. 18, 2023**

(54) METAL PALLET

(71) Applicant: Michael Rickabaugh, Spring Arbor, MI (US)

(72) Inventor: Michael Rickabaugh, Spring Arbor, MI (US)

(73) Assignee: Michael Rickabaugh, Spring Arbor, MI (US)

( * ) Notice: Subject to any disclaimer, the term of this patent is extended or adjusted under 35 U.S.C. 154(b) by 30 days.

This patent is subject to a terminal disclaimer.

(21) Appl. No.: 17/543,445

(22) Filed: Dec. 6, 2021

(65) Prior Publication Data

US 2022/0089322 A1 Mar. 24, 2022

Related U.S. Application Data

(63) Continuation-in-part of application No. 17/074,822, filed on Oct. 20, 2020, now Pat. No. 11,242,173.

(60) Provisional application No. 62/923,935, filed on Oct. 21, 2019.

(51) Int. Cl.
*B65D 19/00* (2006.01)

(52) U.S. Cl.
CPC ..... *B65D 19/0026* (2013.01); *B65D 2519/00024* (2013.01); *B65D 2519/00059* (2013.01); *B65D 2519/00129* (2013.01); *B65D 2519/00273* (2013.01); *B65D 2519/00288* (2013.01); *B65D 2519/00323* (2013.01); *B65D 2519/00333* (2013.01); *B65D 2519/00437* (2013.01)

(58) Field of Classification Search
CPC ..... B65D 19/08; B65D 19/0026; B65D 2519/00024; B65D 2519/00059; B65D 2519/00407; B65D 2519/00796; B65D 2519/00129; B65D 2519/00273; B65D 2519/00288; B65D 2519/00323; B65D 2519/00333
USPC ..... 108/57.32
See application file for complete search history.

(56) References Cited

U.S. PATENT DOCUMENTS

| | | | |
|---|---|---|---|
| 1,202,046 | A | 10/1916 | Freeze |
| 1,321,812 | A | 11/1919 | Drumm |
| 1,334,409 | A | 3/1920 | Sindelar |

(Continued)

FOREIGN PATENT DOCUMENTS

| | | | |
|---|---|---|---|
| CN | 2510408 | Y | 9/2002 |

*Primary Examiner* — Jose V Chen
(74) *Attorney, Agent, or Firm* — Endurance Law Group PLC

(57) ABSTRACT

A sheet metal pallet assembly includes a deck and an undercarriage. The deck is reinforced about its outer edges by perimeter under-girding. The interior of the deck is further reinforced by one or more reinforcement ribs and interior longitudinal girding. The undercarriage is composed of left and right fork tube risers joined together by bridges. The fork tube risers are configured to receive the tines of a forklift truck. Each fork tube riser has inner and outer legs, each splayed at an angle. In some examples, the splay angle of the outer leg is greater than the splay angle of the inner leg, but in other examples the splays are equal. The ends of each fork tube riser may be folded over with a hem to improve strength and present a blunt edge. The undercarriage may be fabricated from a single monolithic piece of sheet metal or multiple pieces.

19 Claims, 19 Drawing Sheets

(56) References Cited

U.S. PATENT DOCUMENTS

| | | | |
|---|---|---|---|
| 1,359,835 | A | 11/1920 | Pease |
| 1,508,898 | A | 9/1924 | Smith |
| 1,612,382 | A | 12/1926 | Lehman |
| 1,665,299 | A | 4/1928 | Cushwa |
| 1,803,416 | A | 5/1931 | Walp |
| 1,807,912 | A | 6/1931 | Soren |
| 2,152,086 | A | 3/1939 | Powell |
| 2,447,542 | A | 8/1948 | Seward |
| 2,475,370 | A | 7/1949 | Bitney |
| 2,487,687 | A | 11/1949 | Arthur et al. |
| 2,546,830 | A | 3/1951 | Mckin |
| 2,615,661 | A | 10/1952 | Cushman |
| 2,692,107 | A | 10/1954 | De Ridder et al. |
| 2,870,981 | A | 1/1959 | Dellinger et al. |
| 2,936,986 | A | 5/1960 | Johnson |
| 3,120,825 | A | 2/1964 | Johnson |
| 3,167,341 | A | 1/1965 | Higgins |
| 3,172,374 | A | 3/1965 | Allen |
| 3,227,108 | A | 1/1966 | Johnson |
| 3,616,766 | A | 11/1971 | Weiss |
| 3,675,596 | A | 7/1972 | Colas |
| 3,759,193 | A | 9/1973 | Branch |
| 3,762,344 | A | 10/1973 | Chez |
| 3,776,146 | A | 12/1973 | Morrison |
| 3,828,705 | A | 8/1974 | Morrison |
| 4,039,708 | A | 8/1977 | Okada |
| 4,112,854 | A | 9/1978 | Pitchford |
| 4,145,974 | A | 3/1979 | Fleming et al. |
| 4,326,467 | A | 4/1982 | Schleicher et al. |
| 4,424,752 | A | 1/1984 | Aberg |
| 4,485,744 | A | 12/1984 | Umemura et al. |
| D291,935 | S | 9/1987 | Nordstrom |
| 4,697,529 | A | 10/1987 | Kero et al. |
| 5,211,117 | A | 5/1993 | Beamer |
| 5,367,960 | A | 11/1994 | Schleicher |
| 5,377,600 | A | 1/1995 | Speese et al. |
| 5,460,103 | A | 10/1995 | Dunn et al. |
| 7,000,549 | B2 | 2/2006 | Nelson |
| 7,987,796 | B2 | 8/2011 | Nordstrom et al. |
| 8,863,674 | B2 | 10/2014 | Smolenaers |
| 9,555,924 | B2 | 1/2017 | Olvey et al. |
| 9,630,742 | B2 | 4/2017 | Olvey et al. |
| 9,751,657 | B2 | 9/2017 | Dote et al. |
| 62,860,476 | | 6/2019 | Rickabaugh |
| 62,874,582 | | 7/2019 | Rickabaugh |
| 11,242,173 | B2 * | 2/2022 | Rickabaugh ..... B65D 19/08 |
| 2006/0196394 | A1 | 9/2006 | Bailey |
| 2008/0202391 | A1 | 8/2008 | Pisano |
| 2014/0345501 | A1 | 11/2014 | Lundius |
| 2015/0059624 | A1 | 3/2015 | Kuo |

* cited by examiner

METAL PALLET

CROSS REFERENCE TO RELATED APPLICATIONS

This application is a Continuation-in-Part of U.S. Ser. No. 17/074,822 filed on Oct. 20, 2020, which claims priority to Provisional Patent Application US 62/923,935 filed on Oct. 21, 2019, the entire disclosures of which are hereby incorporated by reference and relied upon.

BACKGROUND OF THE INVENTION

Field of the Invention. The invention relates generally to industrial pallets, and more particularly to a pallet fabricated from sheet metal.

Description of Related Art. A pallet, or skid, is used in the storage and transport of goods to enable lifting by a forklift, pallet jack, or other type of handling device. Goods are typically secured to a pallet with a suitable strapping. In many cases, pallets are designed and intended to be re-used multiple times.

While pallets are commonly made of wood, in some cases wood is known to present certain disadvantages. For example, laws may require pallets shipped across certain borders to be made of materials that are incapable of being a carrier of invasive species of insects and plant diseases. Wood (and plastic) pallets are considered fire hazards. Pallets made from wood are sometimes treated with pesticides, fungicides and/or other hazardous chemicals to improve weather resistance. Wood pallets used to transport food can possibly harbor pathogens such as *E. coli* and Listeria.

For these and other reasons, there has been genuine and abiding interest to manufacture pallets from metal. Metal cannot harbor pathogens, invasive species of insects or plant diseases, is not considered a fire hazard, is typically not treated with hazardous chemicals. Metal pallets are strong and thus favored for heavy loads, high-stacking loads, long term dry storage, and loads moved by abusive logistic systems. Metal materials useful in the manufacture of pallets include carbon steel, stainless steel and aluminum to name a few. General advantages of metal pallets are high strength and stiffness, excellent durability, resistance to bugs, the absence of splinters, sanitization, and recyclability.

Despite these advantages, metal pallets also have an array of inherent disadvantages. Higher initial price is one. Metal pallets are more expensive to manufacture compared to wood pallets. However, the higher initial cost can be expected to invert to lower long-term cost due to longer service life of metal pallets compared to wood pallets. Weight is another concern. Metal pallets tend to weight more than wood pallets rated to sustain comparable loads. Metal is slippery compared to wood. The inherent lower friction coefficients of metal mean that loads must be more securely strapped to the metal pallet. The lowest cost type of metal pallets is carbon steel, which is susceptible to rusting. Those materials that are less at risk of corrosion, e.g., stainless steel and aluminum, are considerably more expensive that carbon steel.

Some of these disadvantages, in particular cost and weight, can be mitigated by improvements in design that enable more effective use of lighter-gauge metal stock. However, moving to light gauge sheet metal typically results in a reduction ins load carrying capacity and/or decreased resistance to racking. Racking forces occur in normal use of pallets, such as when a heavily loaded pallet experiences a sideways force. Frictional resistance at the bottom of the assembly (due to the weight force) will introduce racking stresses between the deck and floor of the pallet assembly. The left and right fork tube risers must be capable of resisting this racking load.

Moreover, as mentioned above, the higher initial cost of a metal pallet is often justified by the expectation of a long service life. Unfortunately, a longer service life means more opportunities for exposure to damage. Damage, caused overwhelmingly by fork truck usage, can cause unsafe stacking conditions.

There is therefore a continuing desire within the industrial community for an improved metal shipping pallet that retains all of the normal functionality of pallets in use today, and all of the advantages of a metal pallet in particular, but suffers less from the known shortcomings of metal pallets, namely high initial cost and high weight and service-related damage.

BRIEF SUMMARY OF THE INVENTION

A sheet metal pallet assembly comprises a deck has a top surface and a bottom surface. The deck has left and right longitudinal edges as well as first and second transverse edges. The left and right longitudinal edges define a longitudinal direction of the assembly and a length of the deck. Perimeter under-girding is disposed along the bottom surface of the deck adjacent each of the left and right longitudinal edges and the first and second transverse edges. At least one reinforcement rib is in direct engagement with the bottom surface the deck and is directly connected to the perimeter girding. A left fork tube riser is disposed below the bottom surface of the deck adjacent the left longitudinal edge. The left fork tube riser extends generally the length of the deck between the first and second transverse edges. The left fork tube riser has a left inner leg and a left outer leg. The left fork tube riser has a left floor interconnecting the left inner and outer legs. The left outer leg has an upper edge in direct contact with the bottom surface of the deck. The left outer leg has a left outer interface in direct contact with the left floor. The left inner leg has an upper edge. The interior longitudinal girding is disposed along the upper edge of the left inner leg. The left inner leg has a left inner interface in direct contact with the left floor. A right fork tube riser is disposed below the bottom surface of the deck adjacent the right longitudinal edge. The right fork tube riser extends generally the length of the deck between the first and second transverse edges. The right fork tube riser has a right inner leg and a right outer leg. The right fork tube riser has a right floor interconnecting the right inner and outer legs. The right outer leg has an upper edge in direct contact with the bottom surface of the deck. The right outer leg has a right outer interface in direct contact with the right floor. The right inner leg has an upper edge. The interior longitudinal girding is disposed along the upper edge of the right inner leg. The right inner leg has a right inner interface is in direct contact with the right floor. At least one bridge extends between the left floor of the left fork tube riser and the right floor of the right fork tube riser.

The pallet assembly can be manufactured relatively inexpensively from light-weight sheet metal and still perform to necessary industry specifications.

BRIEF DESCRIPTION OF THE SEVERAL VIEWS OF THE DRAWINGS

These and other features and advantages of the present invention will become more readily appreciated when considered in connection with the following detailed description and appended drawings, wherein.

DETAILED DESCRIPTION OF THE INVENTION

Figure 1:
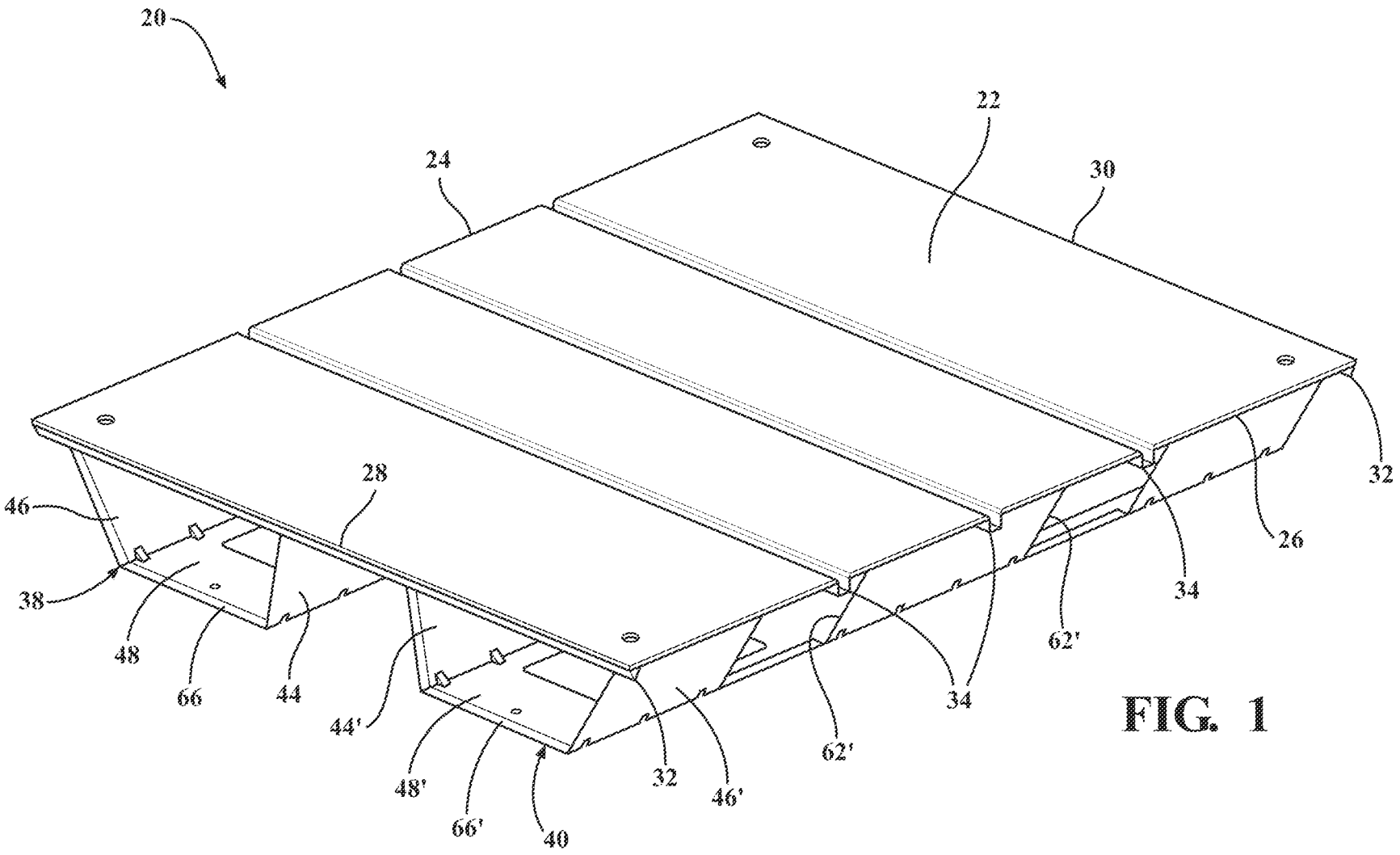
FIG. 1 is a perspective view of a pallet assembly according to an embodiment of the invention.

Referring to the figures, wherein like numerals indicate like or corresponding parts throughout the several views, a fabricated sheet metal pallet assembly is generally shown at 20 in FIGS. 1-12.

The assembly 20 includes a deck 22 upon which loads/cargo (not shown) are placed. The deck 22 has an upwardly facing top surface, and a downwardly facing bottom surface. The deck 22 can take any number of geometric shapes, but in the most common and traditional configuration has a generally rectangular in shape dimensioned to suit a particular intended application or general class of applications. As perhaps best shown in FIG. 1, the geometric shape of the deck 22 is defined, generally, by left 24 and right 26 longitudinal edges. In the illustrated examples, the left 24 and right 26 longitudinal edges are arranged parallel to one another. The deck 22 also has first 28 and second 30 transverse edges. The first 28 and second 30 transverse edges are also arranged parallel to one another. In the rectangular configuration illustrated in the examples, it will be observed that the first 28 and second 30 transverse edges perpendicularly adjoin opposite ends of the left 24 and right 26 longitudinal edges. It can also be seen that the left 24 and right 26 longitudinal edges are longer than the first 28 and second 30 transverse edges, however this is not necessarily the case in every expression of the pallet assembly 20.

The left 24 and right 26 longitudinal edges define a longitudinal direction of the assembly 20, as well as a length of the deck 22. That is to say, when speaking of the length of the assembly 20, or of components of the assembly 20, the measurement is taken in the longitudinal direction. And when speaking of the width of the assembly 20, or of components of the assembly 20, the measurement is taken in the transverse direction—i.e., parallel to the first 28 and second 30 transverse edges.

Figure 10:
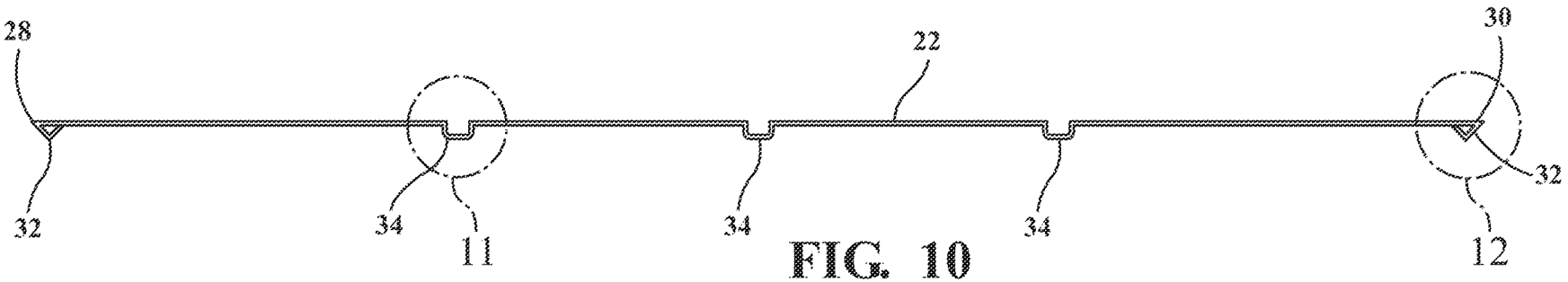
FIG. 10 is a side view of the deck of the pallet assembly of FIG. 1.

The deck 22 is shown as an independent member in the exploded view of FIG. 3 and again in the side view of FIG. 10. From these perspectives, the deck 22 can be seen to include perimeter under-girding to strengthen its outer edges. The perimeter under-girding can take many forms. In the example of FIGS. 1-12, the perimeter under-girding includes transverse perimeter girding 32 disposed adjacent each of the first 28 and second 30 transverse edges. The purpose of the transverse perimeter girding 32 is to provide structure rigidity to the transverse edges 28, 30 of the deck 22, and also to increase their resistance to impact strikes. The transverse perimeter girding 32 can take many different forms to achieve these purposes, including flange-like and solid ribbing embellishments. However, in the illustrated examples the transverse perimeter girding 32 has a tubular cross-section which has been formed integrally (by bending) with the deck 22. The tubular cross-section of transverse perimeter girding 32 can be rectangular or rounded in shape, but in the exemplary embodiment is shown to have a particularly efficient triangular shape. This is perhaps best seen in the detail of FIG. 12, wherein the shape is that of an equilateral triangle, generally, presenting a comfortable rounded edge along the respective transverse edge 28, 30. In this configuration, the hollow triangular form is particularly resistant to bending moments generated by weight force loads, thus structurally enhancing the load-supporting capacity of the deck 22. Also, the generously rounded outer edge 28, 30 will absorb impact strikes such as those foreseeably encountered in normal usage as well as present a blunted edge for safer handling.

Figure 11:
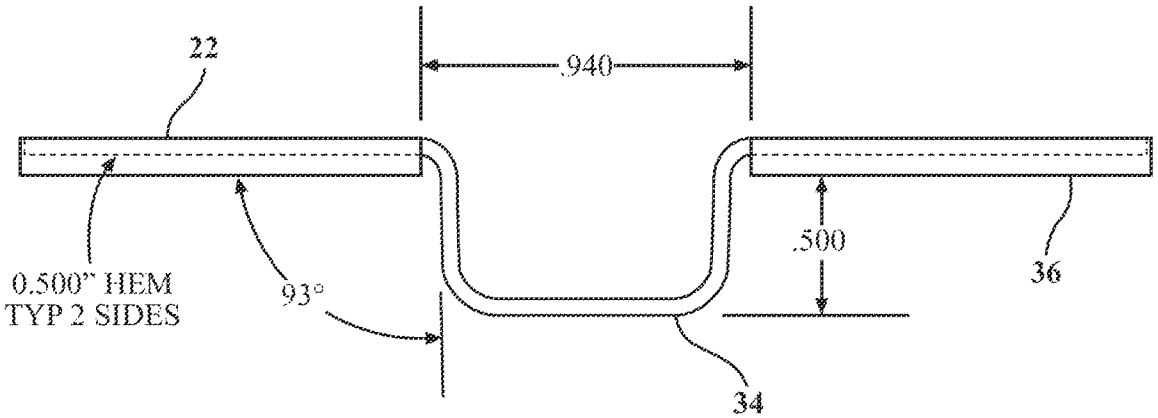
FIG. 11 is an enlarged view of the area circumscribed at 11 in FIG. 10.

In addition to the transverse perimeter girding 32, the perimeter under-girding also includes at least one transverse reinforcement rib 34 extending between the left 24 and right 26 longitudinal edges of the deck 22. In some embodiments, a plurality of spaced-apart transverse reinforcement ribs 34 are employed. The transverse reinforcement ribs 34 cooperate with the transverse perimeter girding 32 to resist bending moments generated by weight force loads and structurally enhance the load-supporting capacity of the deck 22. Each transverse reinforcement rib 34 extends, at least partially, below the bottom surface of the deck 22, as can be easily appreciated from FIGS. 3 and 10. The transverse reinforcement ribs 34 can take a variety of different shapes and configurations. In some contemplated embodiments, the transverse reinforcement ribs 34 comprise flanges or fins that depend from the bottom surface of the deck. In other contemplated embodiments, the transverse reinforcement ribs 34 will take the form of solid bar stock. However, in the illustrated examples the transverse reinforcement ribs 34 have a hollow or channel-like shaped which has been formed integrally (by bending) with the deck 22 so as to reveal elongated slots that open through the upper surface of the deck 22. These slot-like formations provide natural friction to loads and also perform a gutter-like function to separate liquids from direct contact with the load. As shown in the detail of FIG. 11, the transverse reinforcement ribs 34 are rectangular or squared in shape, but in in other contemplated embodiments may be triangular or rounded in shape to name a few examples. In the example of FIG. 11, the vertical sides of the reinforcement rib 34 are approximately 0.500 inches tall and set with a slight draft angle, suggested as 93°, to facilitate the forming tool. The width of the reinforcement rib 34 is suggested as 0.940 inches. Naturally, these dimensions can be varied to suit the application.

Figure 8:
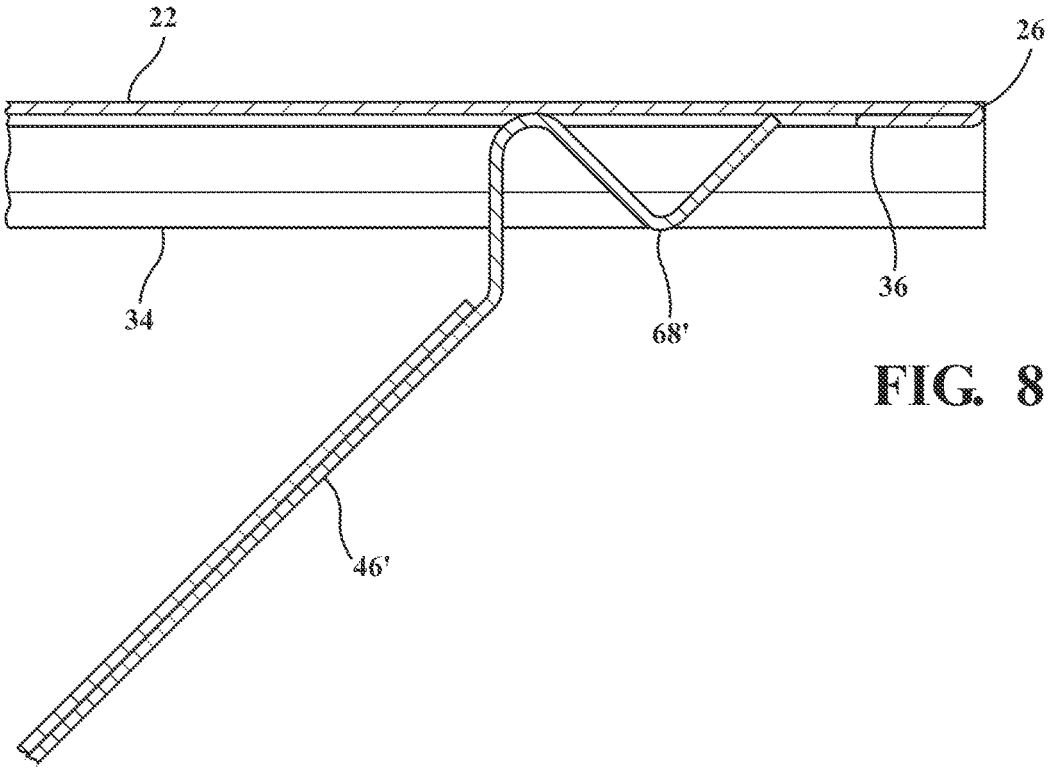
FIG. 8 is an enlarged view of the area circumscribed at 8 in FIG. 6.
Figure 9:
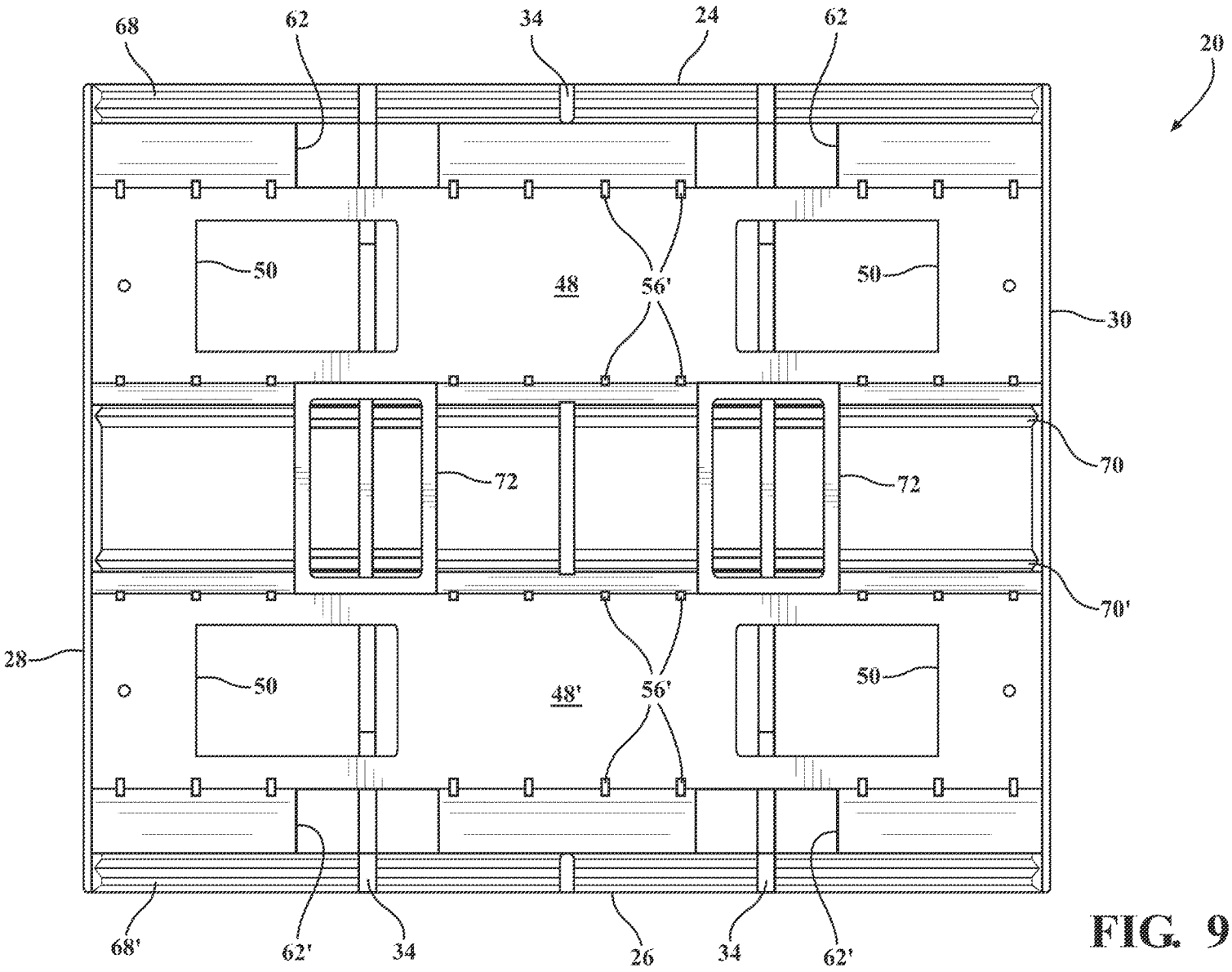
FIG. 9 is a bottom view of the pallet assembly of FIG. 1.
Figure 12:
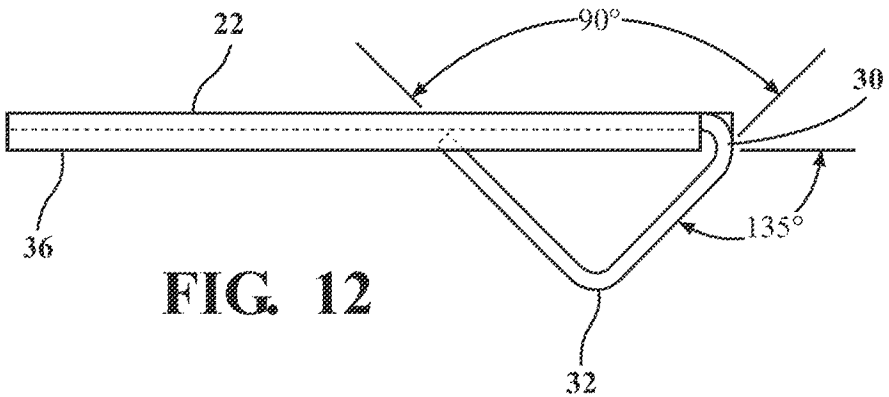
FIG. 12 is an enlarged view of the area circumscribed at 12 in FIG. 10.

The left 24 and right 26 longitudinal edges of the deck 22 may include a fold-over or hem 36, as shown clearly in FIG. 8, and also called-out in FIGS. 11 and 12. The hem 36 along the longitudinal edges 24, 26 can be discontinuous, i.e., interrupted, at the intersection with each reinforcement rib 34 as shown in FIG. 11. The hems 36 help absorb impact strikes, present blunted edges for safer handling, and provide a modest increase in rigidity for the deck 22.

Figure 2:
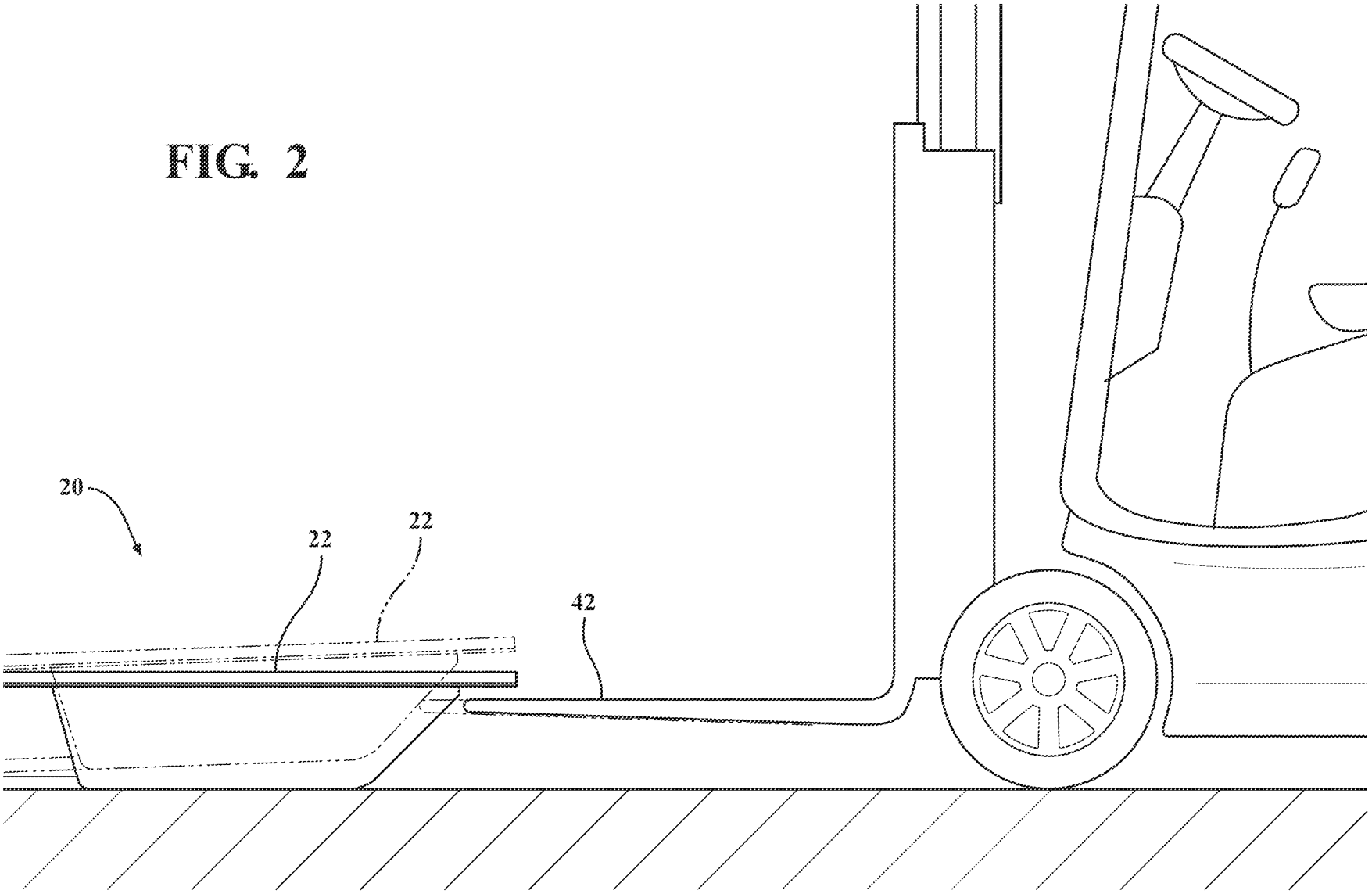
FIG. 2 is an environmental view depicting a fragmentary portion of the pallet of FIG. 1 as it is struck with the tines of a fork truck.

A left fork tube riser, generally indicated at 38, is disposed below the bottom surface of the deck 22 adjacent the left longitudinal edge 24. Similarly, a right fork tube riser 40 is disposed below the bottom surface of the deck 22 adjacent the right longitudinal edge 26. The left 38 and right 40 fork tubes comprise the undercarriage of the pallet assembly 20. The fork tube risers 38, 40 are spaced apart from one another and each extends generally the length of the deck 22 between the first 28 and second 30 transverse edges, as shown throughout the figures. The fork tube risers 38, 40 support the deck 22 above the ground surface, and provide tunnel-like shafts to receive the tines 42 of a forklift (FIG. 2). That is to say, the lengthwise (longitudinal) interior cavity of each fork tube riser 38, 40 is designed to accept the elongated tine 42 of a forklift so that the assembly 20 can be lifted and moved with a forklift in the normal course of industrial/commercial handling. The left 38 and right 40 fork tube risers are mirror images of one another, but for completeness will be described now in separate detail.

The left fork tube riser 38 has a left inner leg 44 and a left outer leg 46. The left outer leg 46 is proximate the left longitudinal edge 24, whereas the left inner leg 44 is proximate to an imaginary longitudinal centerline of the deck 22. The left legs 44, 46 extend the full length of the left fork tube riser 38. That is, each left leg 44, 46 extends generally the length of the deck 22 between the first 28 and second 30 transverse edges. In this manner, the left inner 44 and outer 46 legs provide independent support to the entire length of the deck 22.

Figure 3:
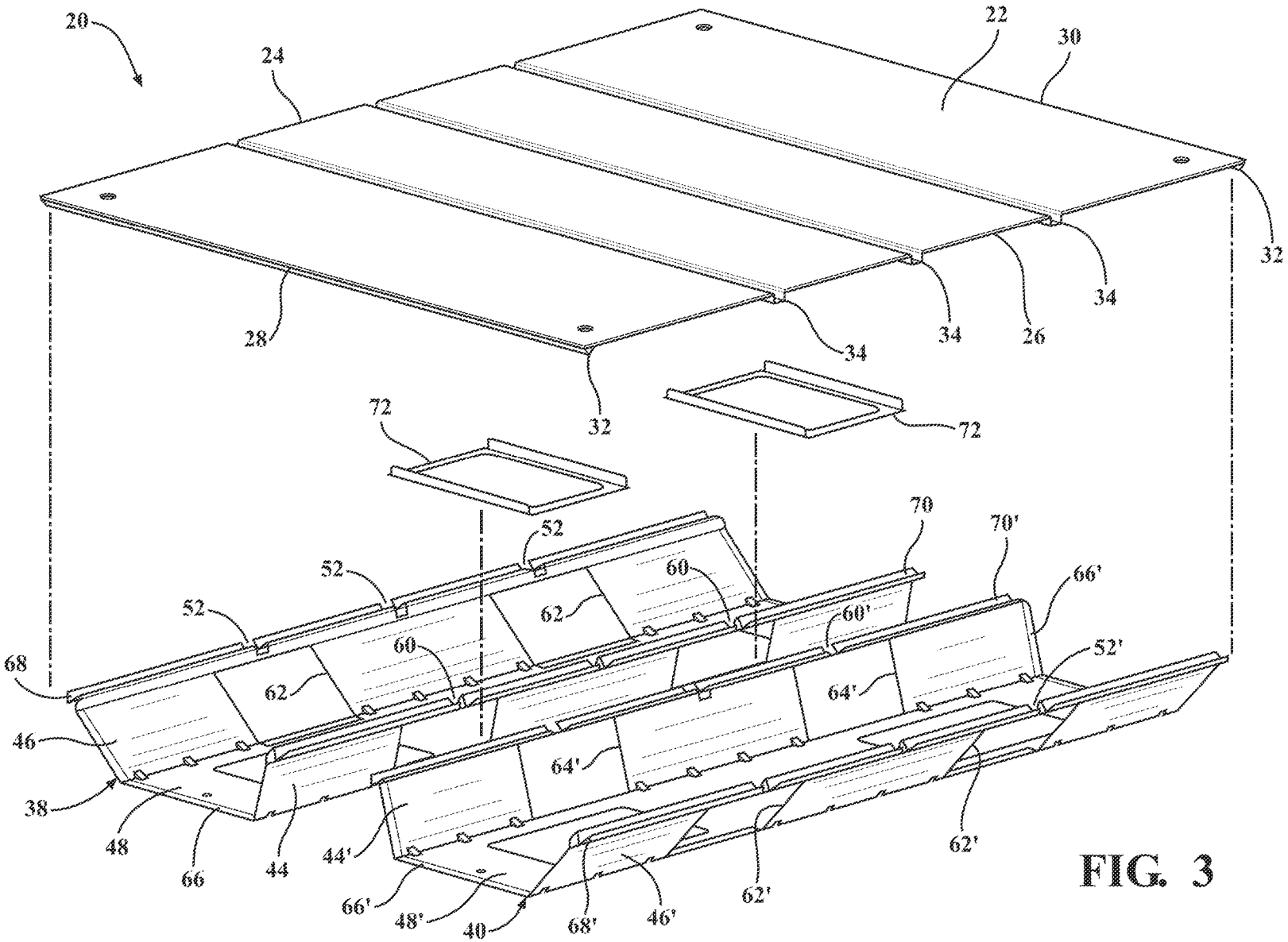
FIG. 3 is an exploded view of the pallet assembly of FIG. 1.
Figure 4:
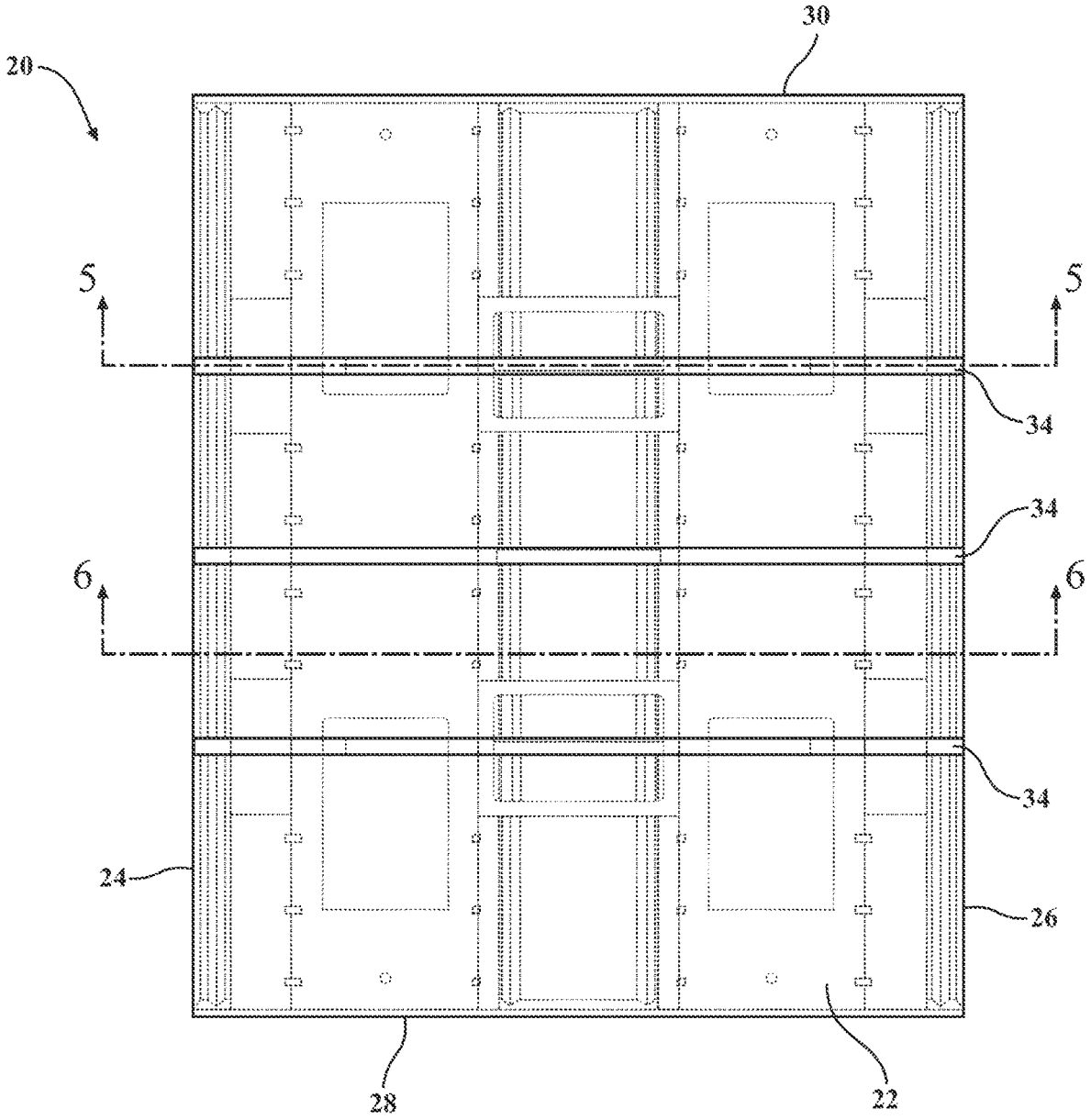
FIG. 4 is a top view of the pallet assembly of FIG. 1.

A left floor 48 interconnects the left inner 44 and outer 46 legs to complete a box-like construction of the left fork tube riser 38. The left floor 48 is generally parallel to the deck 22 and is adapted to rest directly upon the ground or other underlying support surface. The left floor 48 may be fitted with one or more lightening apertures 50. FIGS. 3 and 4 depict an example where two lightening apertures of generally rectangular shape are formed in the left floor 48.

Figure 6:
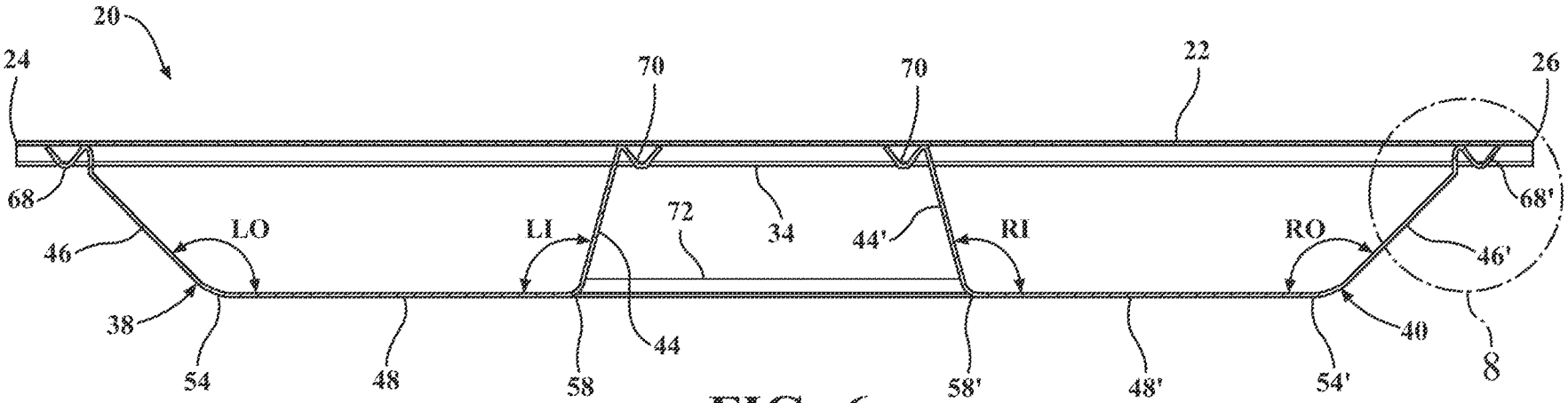
FIG. 6 is a cross-sectional view taken generally along lines 6-6 of FIG. 4.
Figure 7:
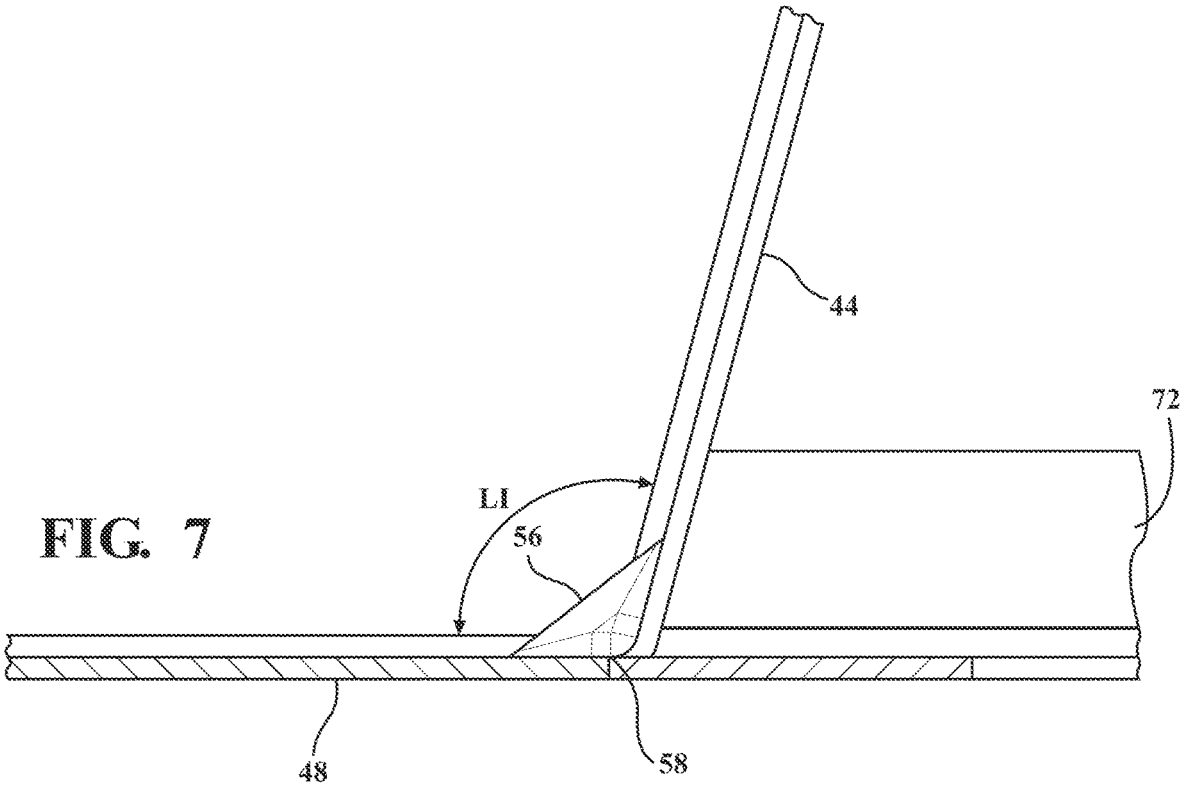
FIG. 7 is an enlarged view of the area circumscribed at 7 in FIG. 5.

The left outer leg 46 has an upper edge in direct contact with the bottom surface of the deck 22, as best shown in FIGS. 6 and 8. A rigid connection between the upper edge of the left outer leg 46 and the deck 22 can be achieved by welding and/or mechanical interlock and/or other suitable fixation technique(s). The upper edge of the left outer leg 46 may include interruptions 52 at each intersection with the transverse reinforcement ribs 34. Details concerning the configuration and functional attributes of the upper edge of the left outer leg 46 will be described below.

Figure 5:
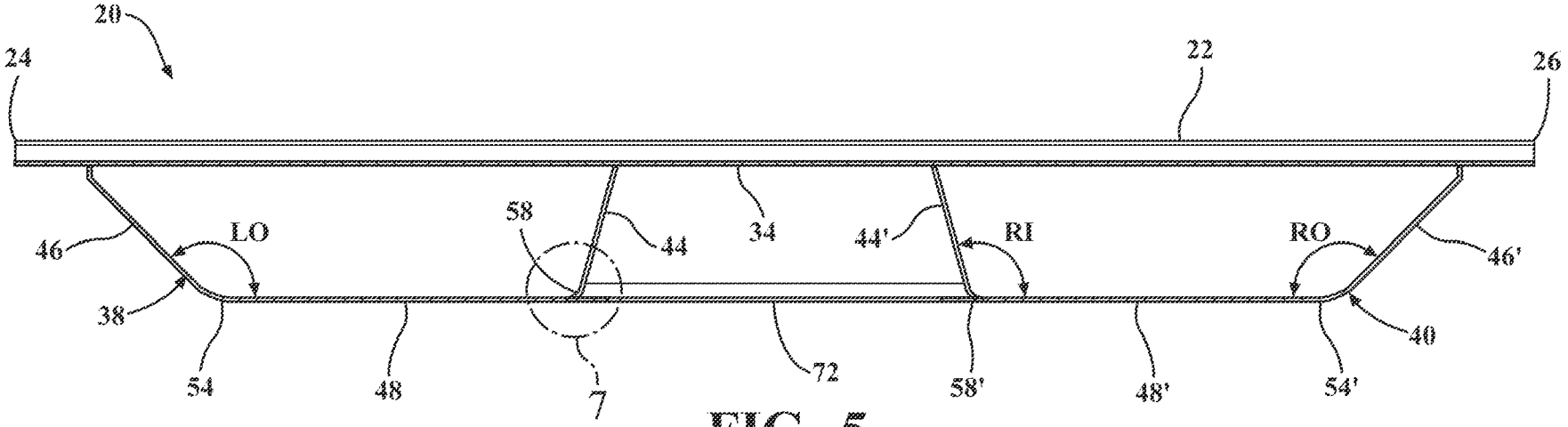
FIG. 5 is a cross-sectional view taken generally along lines 5-5 of FIG. 4.

The left outer leg 46 has a left outer interface 54 in direct contact with the left floor 48. The left outer interface 54 defines a left outer angle LO measured inside between the left floor 48 and the left outer leg 46, as indicated in FIGS. 5 and 6. The left outer angle LO is strategically designed with a significant slant to enable deflection of inadvertent strikes from a fork tine 42, as illustrated in FIG. 2. Rather than sustain crushing damage, the tines 42 will deliver a glancing blow causing the assembly 20 to lift with wedge-like action. It has been found that this favorable deflection of the pallet assembly 20 will tend to occur more often when the left outer angle LO is at least 100°. However, the greater the angle LO, the less component of vertical strength is available to support the deck 22. (It being understood that a 90° angle LO would provide maximum vertical strength, but no deflection performance.) Thus, it has been found that sufficient vertical load carrying capacity can be achieved when the left outer angle LO is at most 165°. Expressed mathematically: $100° \leq LO \leq 165°$. In certain embodiments, the more limited range of left outer angle LO 105-130° has been found to provide superior results. In the examples of FIGS. 1-12, optimal results have been achieved when the left outer angle LO is about 130°. A plurality of gussets 56 may be formed along the left outer interface 54 to enhance rigidity of the left outer angle LO.

In a manner somewhat similar to the left outer leg 46, the left inner leg 44 also has an upper edge and a left inner interface 58 in direct contact with the left floor 48. The upper edge of the left inner leg 44 is in direct contact with the bottom surface of the deck 22, as best shown in FIGS. 5-6. A rigid connection between the upper edge of the left inner leg 44 and the deck 22 can be achieved by welding and/or mechanical interlock and/or other suitable fixation technique (s). The upper edge of the left inner leg 44 may include interruptions 60 at each intersection with the transverse reinforcement ribs 34. Details concerning the configuration and functional attributes of the upper edge of the left inner leg 44 will also be described below.

The left inner interface 58 defines a left inner angle LI measured on the inside between the left floor 48 and the left inner leg 44, as indicated in FIGS. 5 and 6. Those of skill in the art will appreciate that a 90° angle LI would provide maximum vertical strength, but some degree of splay can be introduced to optimize support for the deck 22 and minimize footprint of the floor 48. Satisfactory results have been found when the left inner angle LI is fixed in a range between about 90-135°. Expressed mathematically: $90° \leq LI \leq 135°$. In certain embodiments, the more limited range of left inner angle LI 90-110° has been found to provide superior results. In the examples of FIGS. 1-12, optimal results have been achieved when the left outer angle LO is about 105°. A plurality of gussets 56 may be formed along the left inner interface 58 to enhance rigidity of the left inner angle LI.

A particularly noteworthy attribute of the present invention is that the left outer angle LO can be asymmetric with respect to the left inner angle LI. Having dissimilar or asymmetric outer LO and inner LI angles is a distinctive design feature of this invention and contributes to increased resistance to shear loads such as occur when a heavily loaded pallet assembly 20 is pushed sideways. In such cases, frictional resistance at the bottom of the assembly 20 will introduce a serious racking stresses. Maintaining the one angle greater than the other will resist deflection in the assembly 20 arising from these types of shear loads. In the illustrated examples, the left outer angle LO is greater than the left inner angle LI. Expressed mathematically: LO>LI. Thus, even though there is overlap in the cited ranges for LO and LI, it should be the case that LO>LI in order to best achieve the several, sometimes competing, desirable attributes of this invention. Establishing the left outer angle LO greater than the left inner angle LI is a distinctive design feature of this invention and contributes to increased resistance to shear loads by directing the shear resistance stresses toward the laterally distal edges 24, 26 of the assembly 20. That is, serious racking stresses can best be resisted over a wider footprint, which occurs when the left outer angle LO is established to be greater than the left inner angle LI.

The left outer leg 46 is formed with a pair of outer windows 62. The left inner leg 44 also has a pair of inner windows 64. The left outer windows 62 are transversely aligned with the left inner windows 64. The significance of the windows 62, 64 will be described subsequently.

The end of the left fork tube riser 38 adjacent the first transverse edge 28 comprises a first left end, and the end of the left fork tube riser 38 adjacent the second transverse edge 30 comprises a second left end. From FIGS. 1 and 3, it can be seen that the left fork tube riser 38 includes a fold-over hem 66 along each of the first and second left ends. The hems 66 are similar to the hems 36 mentioned previously, in that hems 66 help absorb impact strikes, present blunted edges for safer handling, and provide a modest increase in rigidity for the left fork tube riser 38.

Again stated, the left 38 and right 40 fork tube risers are mirror images of one another. The features of the right fork tube riser 40 will be described presently using like or corresponding reference numbers to those of the left fork tube riser 38 but with prime designations.

The right fork tube riser 38 has a right inner leg 44' and a right outer leg 46'. The right outer leg 46' is proximate the right longitudinal edge 24, whereas the right inner leg 44' is proximate to an imaginary longitudinal centerline of the deck 22. The right legs 44', 46' extend the full length of the right fork tube riser 38. That is, each right leg 44', 46' extends generally the length of the deck 22 between the first 28 and second 30 transverse edges. In this manner, the right inner 44' and outer 46' legs provide independent support to the entire length of the deck 22.

A right floor 48' interconnects the right inner 44' and outer 46' legs to complete a box-like construction of the right fork tube riser 38. The right floor 48' is generally parallel to the deck 22 and is adapted to rest directly upon the ground or other underlying support surface. The right floor 48' may be fitted with one or more lightening apertures 50'. FIGS. 3 and 4 depict an example where two lightening apertures of generally rectangular shape are formed in the right floor 48'.

The right outer leg 46' has an upper edge in direct contact with the bottom surface of the deck 22, as best shown in FIGS. 6 and 8. A rigid connection between the upper edge of the right outer leg 46' and the deck 22 can be achieved by welding and/or mechanical interlock and/or other suitable fixation technique(s). The upper edge of the right outer leg 46' may include interruptions 52' at each intersection with the transverse reinforcement ribs 34. Details concerning the configuration and functional attributes of the upper edge of the right outer leg 46' will be described below.

The right outer leg 46' has a right outer interface 54' in direct contact with the right floor 48'. The right outer interface 54' defines a right outer angle RO measured inside between the right floor 48' and the right outer leg 46', as indicated in FIGS. 5 and 6. The right outer angle RO is strategically designed with a significant slant to enable deflection of inadvertent strikes from a fork tine 42, as illustrated in FIG. 2. Rather than sustain crushing damage, the tines 42 will deliver a glancing blow causing the assembly 20 to lift with wedge-like action. It has been found that this favorable deflection of the pallet assembly 20 will tend to occur more often when the right outer angle RO is at least 100°. However, the greater the angle RO, the less component of vertical strength is available to support the deck 22. (It being understood that a 90° angle RO would provide maximum vertical strength, but no deflection performance.) Thus, it has been found that sufficient vertical load carrying capacity can be achieved when the right outer angle RO is at most 165°. Expressed mathematically: 100°≤RO≤165°. In certain embodiments, the more limited range of right outer angle RO 105-130° has been found to provide superior results. In the examples of FIGS. 1-12, optimal results have been achieved when the right outer angle RO is about 130°. A plurality of gussets 56' may be formed along the right outer interface 54' to enhance rigidity of the right outer angle RO.

In a manner somewhat similar to the right outer leg 46', the right inner leg 44' also has an upper edge and a right inner interface 58' in direct contact with the right floor 48'. The upper edge of the right inner leg 44' is in direct contact with the bottom surface of the deck 22, as best shown in FIGS. 5-6. A rigid connection between the upper edge of the right inner leg 44' and the deck 22 can be achieved by welding and/or mechanical interlock and/or other suitable fixation technique(s). The upper edge of the right inner leg 44' may include interruptions 60' at each intersection with the transverse reinforcement ribs 34. Details concerning the configuration and functional attributes of the upper edge of the right inner leg 44' will also be described below.

The right inner interface 58' defines a right inner angle RI measured on the inside between the right floor 48' and the right inner leg 44', as indicated in FIGS. 5 and 6. Those of skill in the art will appreciate that a 90° angle RI would provide maximum vertical strength, but some degree of splay can be introduced to optimize support for the deck 22 and minimize footprint of the floor 48'. Satisfactory results have been found when the right inner angle RI is fixed in a range between about 90-135°. Expressed mathematically: 90°≤RI≤135°. In certain embodiments, the more limited range of right inner angle RI 90-110° has been found to provide superior results. In the examples of FIGS. 1-12, optimal results have been achieved when the right inner angle RI is about 105°. A plurality of gussets 56' may be formed along the right inner interface 58' to enhance rigidity of the right inner angle RI.

A particularly noteworthy attribute of the present invention is that the right outer angle RO can be asymmetric with respect to the right inner angle RI. Having dissimilar or asymmetric outer RO and inner RI angles is a distinctive design feature of this invention and contributes to increased resistance to shear loads such as occur when a heavily loaded pallet assembly 20 is pushed sideways. In such cases, frictional resistance at the bottom of the assembly 20 will introduce a serious racking stresses. Maintaining the one angle greater than the other will resist deflection in the assembly 20 arising from these types of shear loads. In the illustrated examples, the right outer angle RO is greater than the right inner angle RI. Expressed mathematically: RO>RI. Thus, even though there is overlap in the cited ranges for RO and RI, it should be the case that RO>RI in order to best achieve the several, sometimes competing, desirable attributes of this invention. Establishing the right outer angle RO greater than the right inner angle RI is a distinctive design feature of this invention and contributes to increased resistance to shear loads by directing the shear resistance stresses toward the laterally distal edges 24, 26 of the assembly 20. That is, serious racking stresses can best be resisted over a wider footprint, which occurs when the right outer angle RO is established to be greater than the right inner angle RI. Although not strictly necessary, in most cases the symmetry between the respective fork tube risers 38, 40 will be maintained, such that LO=RO and LI=RI.

The right outer leg 46' is formed with a pair of outer windows 62'. The right inner leg 44' also has a pair of inner windows 64'. The right outer windows 62' are transversely aligned with the right inner windows 64', and also transversely aligned with the left inner 64 and outer 62 windows, to receive the tines 42 of a forklift. That is to say, the crosswise (transverse) alignment of the windows 62, 64, 62', 64' are designed to accept the tines 42 of a forklift so that the assembly 20 can be lifted and moved with a forklift in the normal course of industrial/commercial handling. The provision of windows 62, 64, 62', 64' in combination with the previously described function of the fork tube risers 38, 40, allows "four-way" entry so that a forklift can lift the pallet assembly 20 from all four directions.

The end of the right fork tube riser 38 adjacent the first transverse edge 28 comprises a first right end, and the end of the right fork tube riser 38 adjacent the second transverse edge 30 comprises a second right end. From FIGS. 1 and 3, it can be seen that the right fork tube riser 38 includes a fold-over hem 66' along each of the first and second right ends. The hems 66' are similar to the hems 36 mentioned previously, in that hems 66' help absorb impact strikes, present blunted edges for safer handling, and provide a modest increase in rigidity for the right fork tube riser 38.

Having thus described each of the fork tube risers 38, 40 in detail, attention can now be given to the features incorporated into the pallet assembly 20 that further increase structural integrity of the deck 22. These features include longitudinal perimeter girding 68 and interior longitudinal girding 70. The longitudinal perimeter girding 68 are those affects disposed along the deck 22 adjacent each of the left 24 and right 26 longitudinal edges which provide significant enhancement of load carrying capacity. The interior longitudinal girding 70 is disposed below the bottom surface of the deck 22, and located nearer to the imaginary longitudinal centerline of the assembly 20. In combination, the longitudinal perimeter girding 68 and interior longitudinal girding 70 substantially stiffen the deck 22 so that it can support heavy loads in normal usage.

FIGS. 3 and 6 best show the respective girdings 68, 70 in certain exemplary configurations. Similar to the previously mentioned transverse perimeter girding 32, the longitudinal perimeter girding 68 and interior longitudinal girding 70 can each take many different forms, including fins and solid bar stock embellishments. However, in the illustrated examples the girdings 68, 70 each have a tubular cross-section which has been formed integrally (by bending) with the respective inner 44, 44' and outer 46, 46' legs of the fork tube risers 38, 40. More specifically, the longitudinal perimeter girding 68 is, in one embodiment, integrally formed along the upper edge of the respective outer legs 46, 46'. Similarly, the interior longitudinal girding 70 is, in this same embodiment, integrally formed along the upper edge of the respective inner legs 44, 44'. The tubular cross-section of transverse perimeter girding 32 can be rectangular or rounded in shape, but in the exemplary embodiment is shown to have a particularly efficient triangular shape, which can be clearly seen in the detail of a longitudinal perimeter girding 68 in FIG. 8.

Thus, the longitudinal perimeter girding 68 and interior longitudinal girding 70 each preferably comprise tubular elements that are strategically-located to undergird or brace the deck 22 from below. The interior longitudinal girding 70 spaced apart from the left 24 and right 26 longitudinal edges. As previously mentioned, a rigid connection between the upper edges of each of the inner 44, 44' and outer 46, 46' legs to the deck 22 can be achieved by welding and/or mechanical interlock and/or other suitable fixation technique(s). In one embodiment, a quality weld line is applied along the entire lengths of the touch points between the deck 22 and the upper edges of the inner 44, 44' and outer 46, 46' legs. By integrating the longitudinal perimeter girding 68 and interior longitudinal girding 70 to the inner 44, 44' and outer 46, 46' legs, it will be understood that these girdings 68, 70 are thus fixed directly to the bottom surface of the deck 22.

Also as previously mentioned, interruptions 52, 52' can be formed on the upper edges of the left 46 and right 46' outer legs at each intersection with the transverse reinforcement ribs 34. And likewise, interruptions 60, 60' can be formed on the upper edges of the left 44 and right 44' inner legs at each intersection with the transverse reinforcement ribs 34. From the perspective of FIG. 3, it can be seen that these interruptions 52, 52', 60, 60' are incorporated into the longitudinal perimeter girding 68 and interior longitudinal girding 70. These interruptions 52, 52', 60, 60' provide several benefits in addition to merely facilitating the pass-through of the transverse reinforcement ribs 34. One such benefit is a mechanical interlock. Each interruption 52, 52', 60, 60' is effectively a notch that straddles one of the transverse reinforcement ribs 34. These several "notch over rib" interfaces will mechanically resist racking forces imposed on the pallet assembly 20, thus increasing its structural integrity. Furthermore, these several "notch over rib" interfaces increase the linear length of weld lines that can be formed. The longer a weld line, the greater the interconnected strength of its members. Thus, the interruptions 52, 52', 60, 60' provide several desirable advantages to the pallet assembly 20.

At least one bridge 72 extends between the left fork tube riser 38 and the right fork tube riser 40. In the example of FIGS. 3-6 and 9, two such bridges 72 are shown. Together with the left 38 and right 40 fork tubes, the bridges 72 comprise the undercarriage features of the pallet assembly 20. The bridges 72 directly interconnect the left 58 and right 58' inner interfaces to further enhance structural integrity of the assembly 20. Each bridge 72 in the illustrated examples has a body that is generally co-planar with the left 48 and right 48' floors. Optionally, the body of the bridge 72 may include an interior opening to remove unnecessary weight from the assembly 20. A pair of flanges are disposed along opposite sides of the body, as best seen in FIG. 3. These flanges extend transversely between the respective inner legs 44, 44'. Rigid connection of the bridges 72 to the respective fork tube risers 38, 40 can be accomplished by welding and/or mechanical interlock and/or other suitable fixation technique(s).

Figure 13:
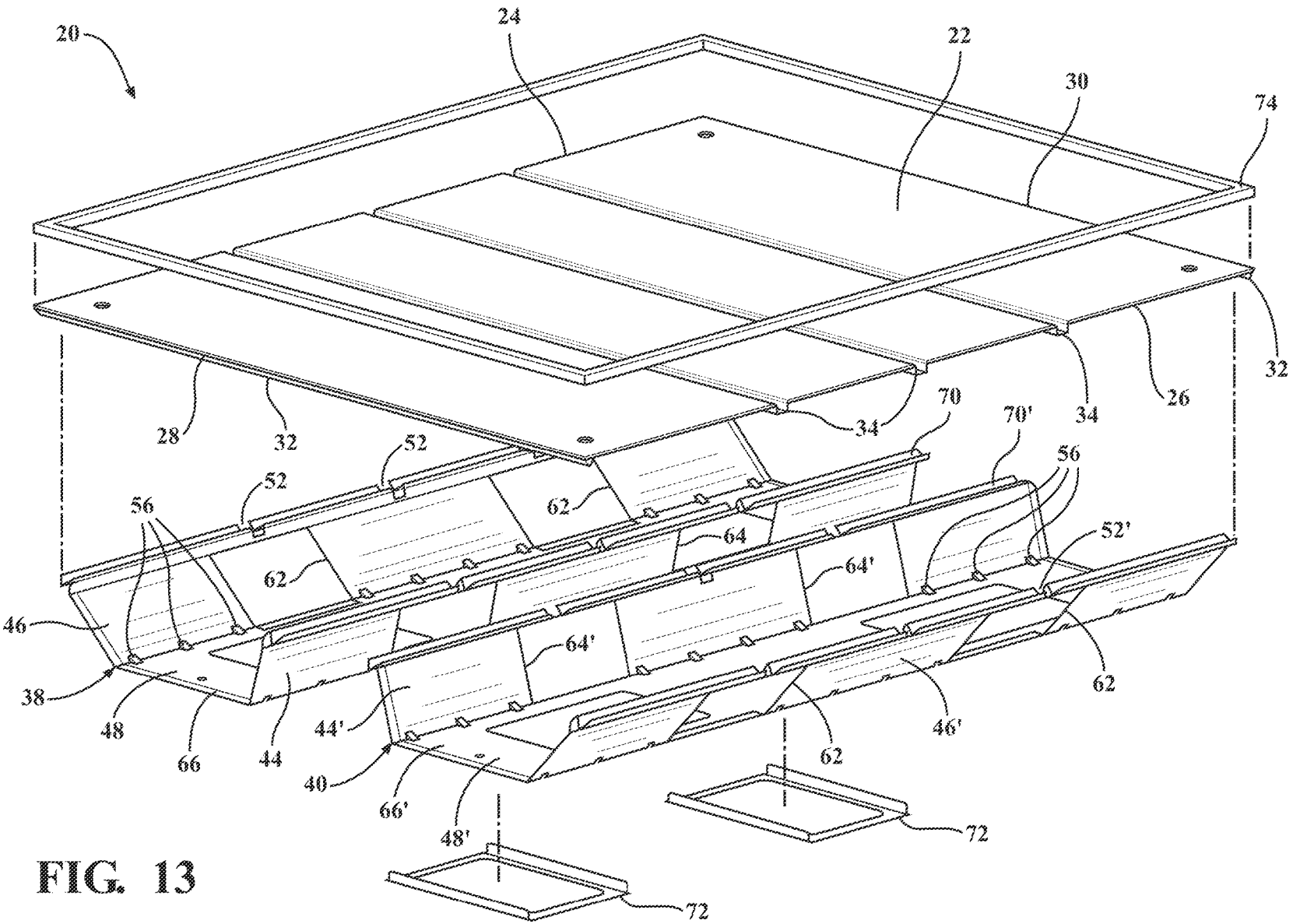
FIG. 13 is an exploded view of a first alternative embodiment of the pallet assembly.

FIG. 13 shows a first alternative embodiment of the invention. FIG. 13 is distinguished from the designs shown in FIGS. 1-12 in that the longitudinal perimeter girding 68 and interior longitudinal girding 70 portions of the perimeter under-girding are supplemented by the inclusion of a perimeter frame 74. That is, the stiffness and structural integrity of the deck 22 is further enhanced by the addition of the perimeter frame 74. The perimeter frame 74 is shown in one exemplary form having a L-shaped cross-section by which a horizontal face overlies the upper surface of the deck 22 and a vertical face hangs like a skirt around the outside edges of the deck 22. Rigid connection of the perimeter frame 74 to the deck 22 can be accomplished by welding and/or mechanical interlock and/or other suitable fixation technique (s). As a consequence, the strength of the deck 22 is improved. Those of skill in the art will envision various modifications of the perimeter frame 74 concept as methods to increase the rigidity and load carrying capacity of the deck 22

Figure 14:
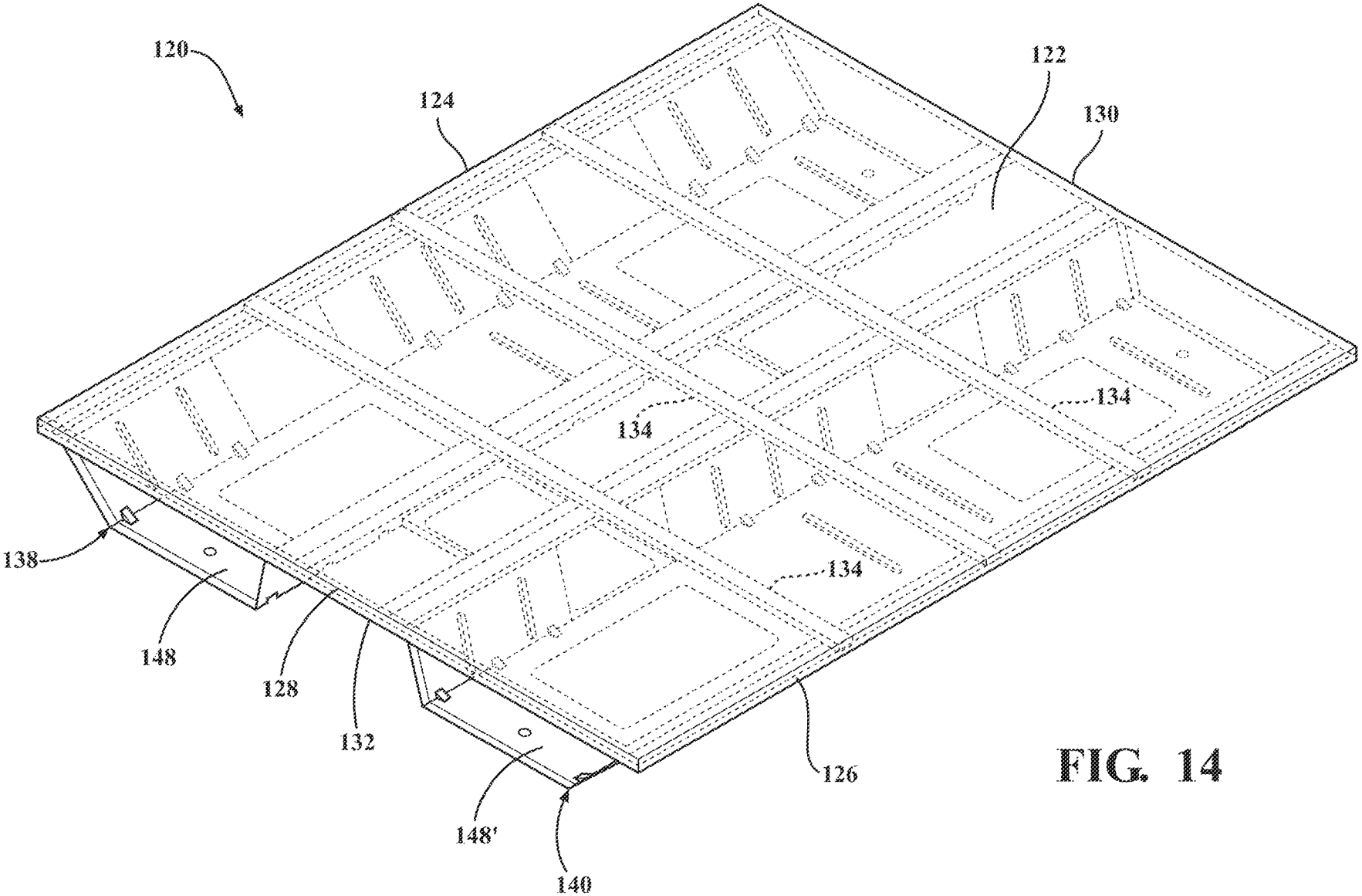
FIG. 14 is a perspective view of a second alternative embodiment of the pallet assembly.
Figure 15:
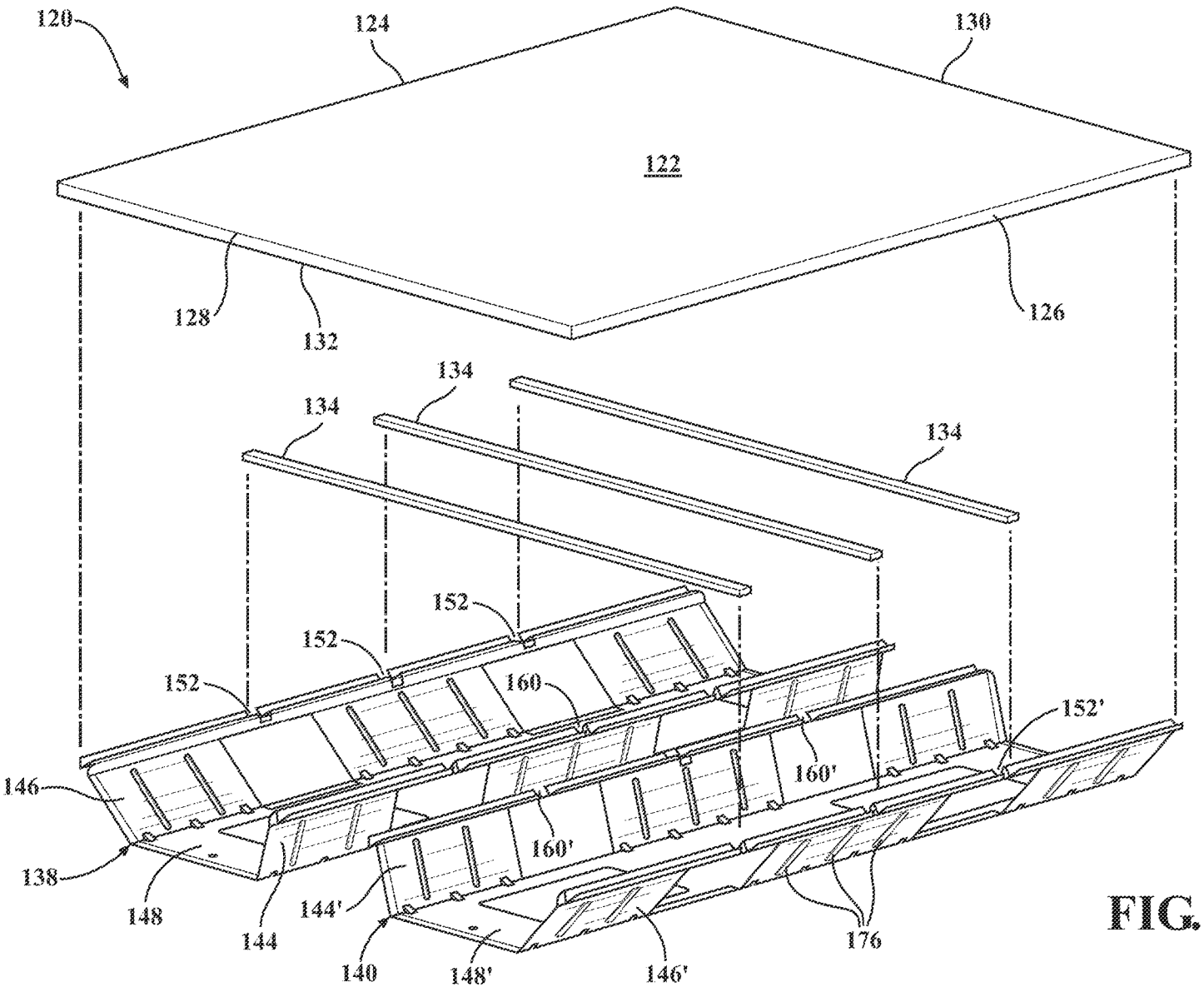
FIG. 15 is an exploded view of the pallet assembly of FIG. 14.

A second alternative embodiment of the invention is shown in FIGS. 14 and 15. The pallet assembly is generally shown at 120. Like or corresponding parts are indicated with like reference numerals offset by 100. This embodiment is distinguished from the designs shown in FIGS. 1-13 in several respects. For one, the deck 122 has a smooth, flat, uninterrupted upper surface. In this example, the perimeter under-girding takes the form of a perimeter frame 174 integrally formed in the deck 122 by under-curling a hollow square edge. This box-like edge adds stiffness and structural integrity to the deck 122. Along the first 128 and second 130 transverse ends, the perimeter frame 174 functions much as the transverse perimeter girding.

Another notable distinction in the second alternative embodiment is that the transverse reinforcement ribs 134 are loose-piece members, whereas in FIGS. 1-13 the transverse reinforcement ribs 34 are formed integrally with the deck 22. In the second alternative embodiment, the transverse reinforcement ribs 134 comprise short sections of rectangular tube stock cut to fit against the bottom side of the deck 122, inside the perimeter frame 174. The interruptions 152, 152', 160, 160' in the left and right fork tube risers 138, 140 serve as cradles for the individual transverse reinforcement ribs 134. Rigid connection of the transverse reinforcement ribs 134, deck 22 and fork tube risers 138, 140 can be accomplished by welding and/or mechanical interlock and/or other suitable fixation technique(s).

Moreover, the second alternative embodiment of FIGS. 14-15 is distinguished by the integral formation of strengthening beads 176 in numerous strategic locations to add rigidity where needed. The examples show a plurality of transversely-extending strengthening beads 176 along the left floor 148 and the right floor 148'. The outer legs 146, 146' each include a plurality of vertically-extending strengthening beads 176. The inner legs 144, 144' also include a plurality of vertically-extending strengthening beads 176. These strengthening beads 176 cooperate with the several other strengthening features to add stiffness and structural integrity to the fork tube risers 138, 140.

As in all of the preceding embodiments, the outer angles LO/RO (not indicated in FIGS. 14-15) are asymmetric with respect to their counterpart inner angles LI/RI (also not indicated in FIGS. 14-15). And, the outer angles LO/RO are each greater than their counterpart inner angles LI/RI.

Although not visible in FIG. 15 and mostly obscured in FIG. 14, bridges of similar configuration extend between the left 138 and right 140 fork tube risers as in the preceding examples. Rigid connection of the bridges to the respective fork tube risers 138, 140 can be accomplished by welding and/or mechanical interlock and/or other suitable fixation technique(s).

Figure 16:
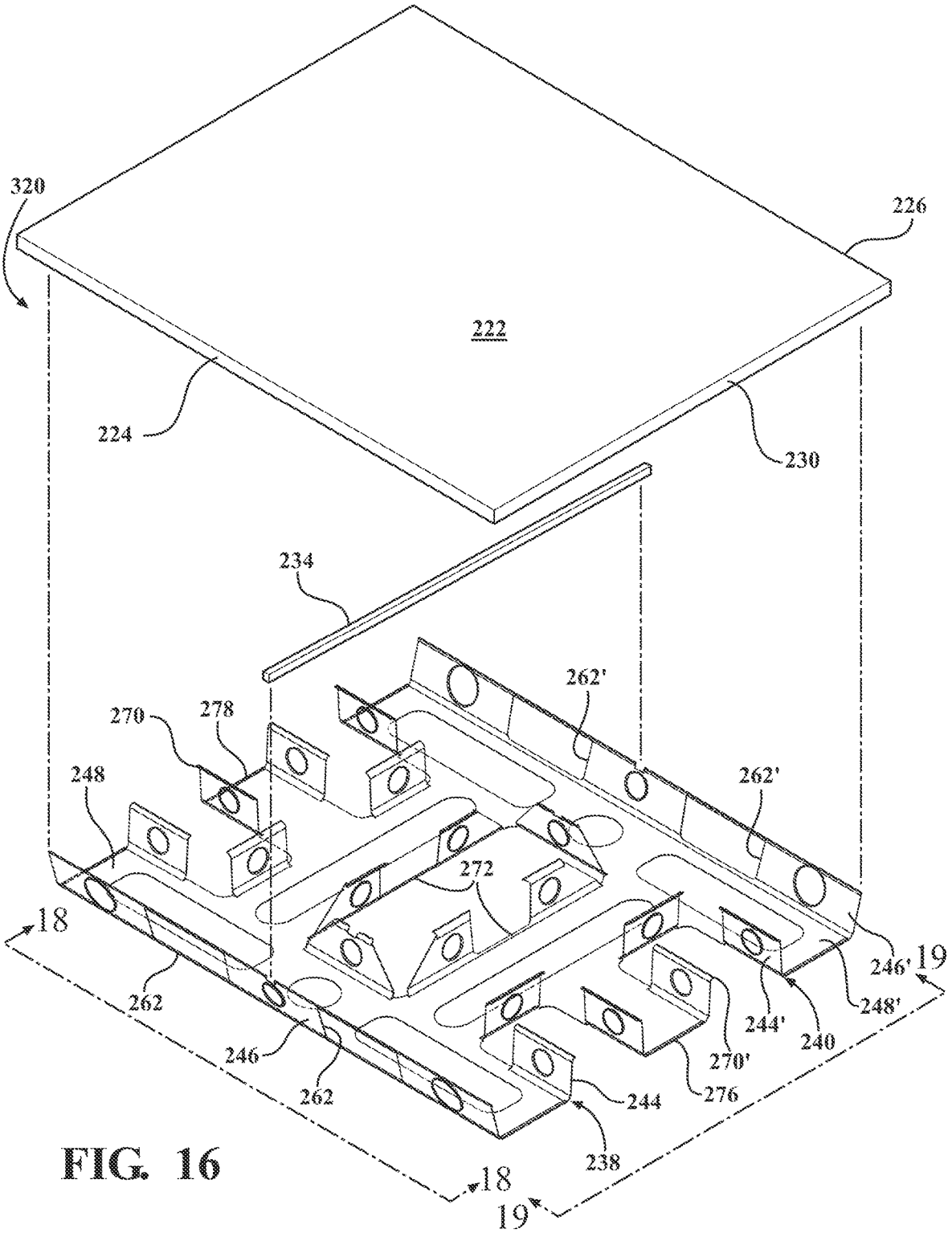
FIG. 16 is an exploded view of a third alternative embodiment of the pallet assembly.
Figure 17:
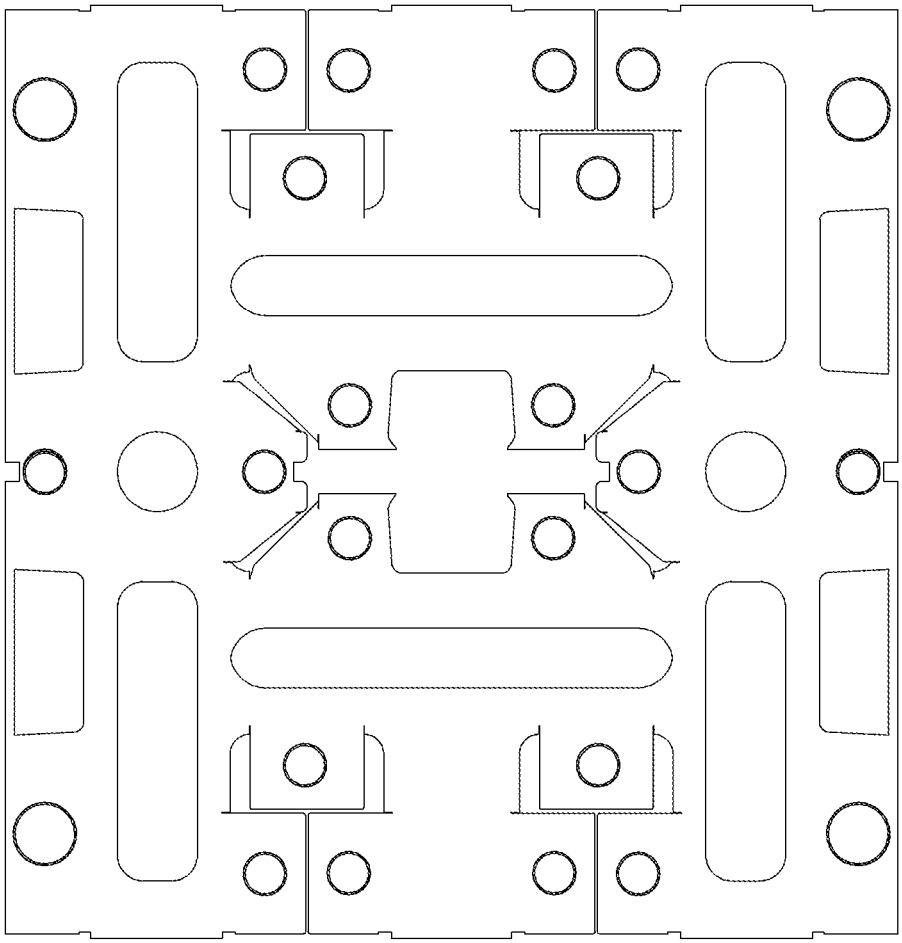
FIG. 17 is a plan view of a die-cut but unfolded precursor stock to formed into the undercarriage features for the pallet assembly of FIG. 16.
Figure 18:
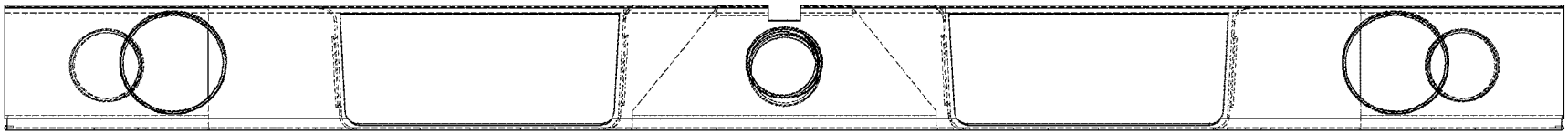
FIG. 18 is a side view of the undercarriage features taken generally along lines 18-18 of FIG. 16.

A third alternative embodiment of the invention is shown in FIGS. 16-19. The pallet assembly is generally shown at 220. Like or corresponding parts are indicated with like reference numerals offset by 200. This third alternative embodiment is distinguished from the designs shown in FIGS. 14-15 in that the undercarriage features, i.e., the left 238 and right 240 fork tubes and bridges 272, are all integrally formed as a monolithic unit. FIG. 17 shows an exemplary die-cut but otherwise flat, unformed unitary piece of sheet metal that is the precursor to the undercarriage features of the assembly 220. A stamping or bending operation performed on the die-cut sheet metal piece will produce the fork tubes 238, 240 and bridges 272 shown in FIG. 16. The elevation view of FIG. 18 shows that even in this configuration, the outer 262 windows can be seen to align thus enabling fork tine 24 (FIG. 2) access from all sides. Inner window are not present in this embodiment because of the position of the bridges 272.

Figure 19:
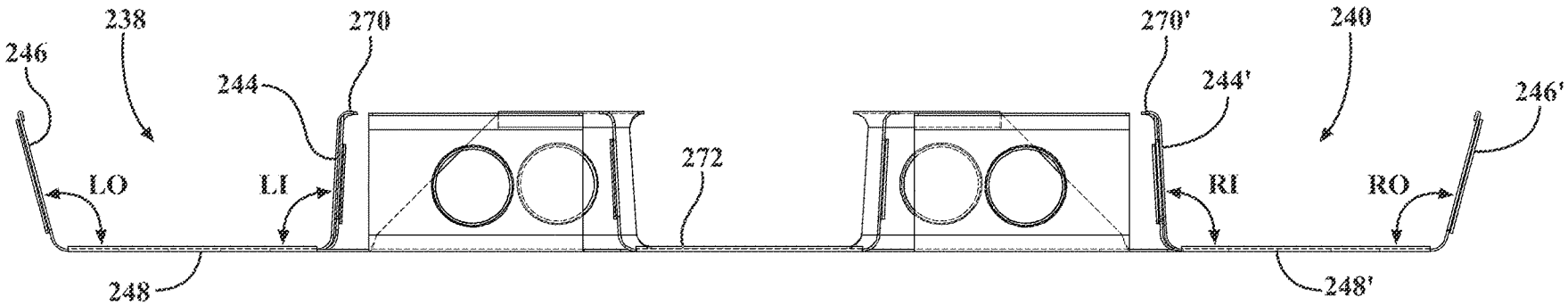
FIG. 19 is an end view of the undercarriage features taken generally along lines 19-19 of FIG. 16.

Examination of the views in FIGS. 16 and 19 will reveal different forms of longitudinal perimeter girding and interior longitudinal girding 270. In the example of this third alternative embodiment, these stiffening features are not triangular. Rather, the interior longitudinal girding 270 formed along the upper edges of the inner legs 244, 244' of the fork tubes 238, 240 comprise outward bends or flares, thus forming supplemental interior longitudinal girding 270 for the deck 222. Also, in terms of the perimeter under-girding, supplemental longitudinal perimeter girding is no longer incorporated into the upper edge of the outer legs 246, 246' of the fork tubes 238, 240. Instead, only the boxed longitudinal edges of the deck 222 serve for longitudinal perimeter girding, like that described in connection with FIGS. 14-15. The upper edge of the outer legs 246, 246' of the fork tubes 238, 240 can, however, be hemmed over to provide some added strength and also to facilitate the welding (or other fixation technique) process.

Another notable distinction in the third alternative embodiment (compared to the second alternative embodiment) is that only one, centrally located, loose-piece transverse reinforcement rib 234 is used. Yet another notable distinction of the third alternative embodiment is the inclusion of first 276 and second 278 intermediate risers. The intermediate risers 276, 278 are located between the left 238 and right 240 fork tube risers, generally centered along the longitudinal centerline of the deck 220. Each intermediate riser 276, 278 has a generally U-shaped configuration somewhat mimicking the U-shapes of the fork tube risers 238, 240. That is to say, the intermediate risers 276, 278 can be see as having a floor co-planar with the floors 248, 248' of the respective fork tube risers 238, 240. In the illustrated example, the floor of each intermediate riser 276, 278 extends integrally from a respective bridge 272, like a tongue. Legs extend upwardly from the floor of the intermediate risers 276, 278 to respective upper edges that flare outwardly, thus forming supplemental interior longitudinal girding 270 for the deck 222.

Furthermore, the end view of FIG. 19 shows the outer and inner angles set for near-maximum load carrying capacity. In this example, the outer angles LO/RO equal approximately 105°, whereas the inner angles LI/RI equal approximately 93°. Even so, it will be appreciated that the outer angles LO/RO are asymmetric with respect to their counterpart inner angles LI/RI. And more specifically, the outer angles LO/RO are each greater than their counterpart inner angles LI/RI. Expressed mathematically: LO>LI and RO>RI. And although it is not strictly necessary, in most cases the symmetry between the respective fork tube risers 238, 240 will be maintained, such that LO=RO and LI=RI.

A still further distinction in the third alternative embodiment can be observed in the bridges 272. In this example, the inner legs 244, 244' of the fork tubes 238, 240 are discontinuous at the junction with the bridges 272. Not only are the bridges 272 fully integrated with the fork tube risers 238, 240, but also their flanges are lengthened to reach to the deck 222. The respective upper edges of these flanges flare outwardly, thus forming supplemental support for the underside of the deck 222 in concert with the transverse reinforcement rib 234. Also, the lightening apertures are shown as generally round or oval in this embodiment.

Figure 20:
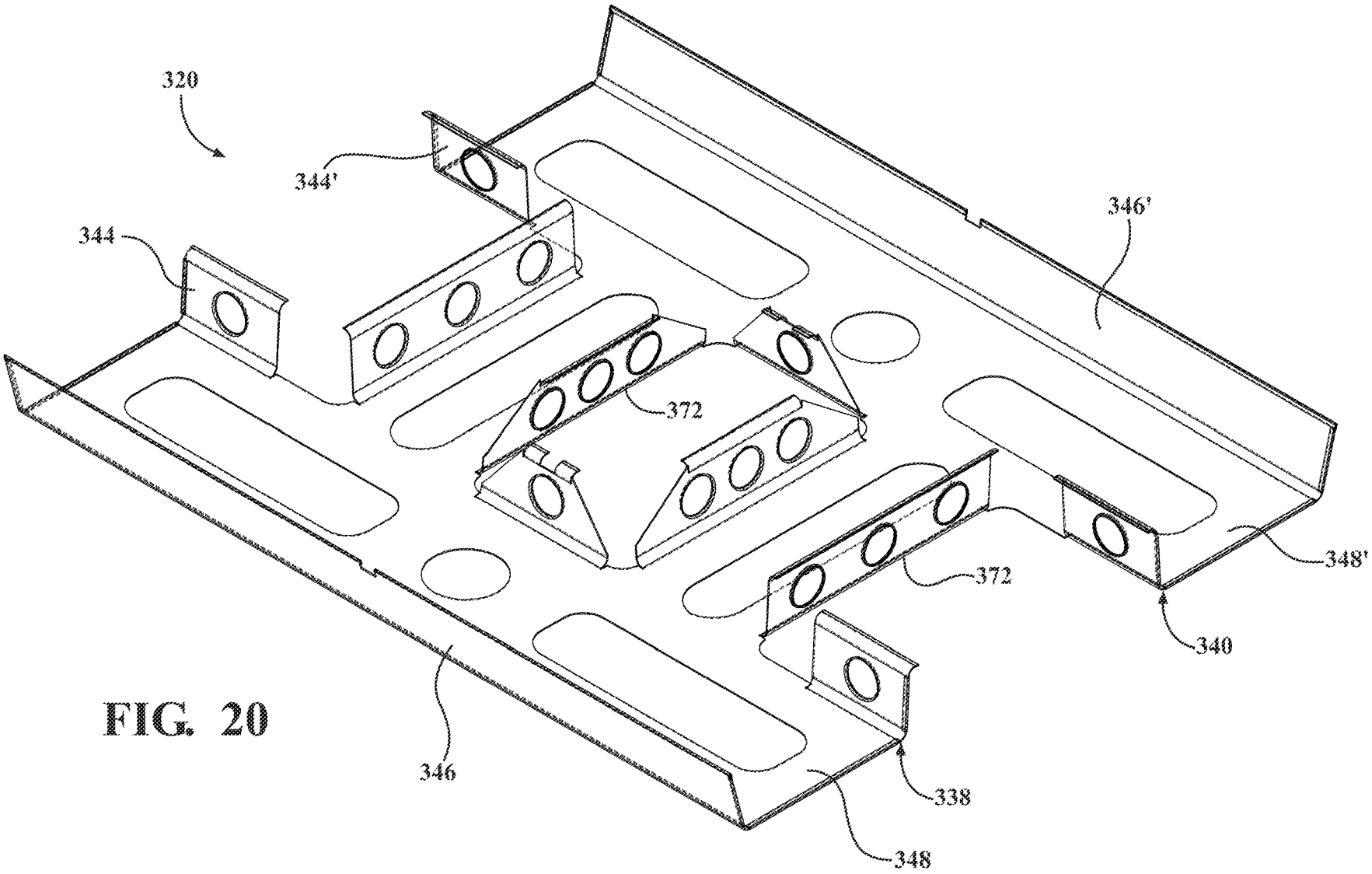
FIG. 20 is a perspective view of the undercarriage features of a fourth alternative embodiment of the pallet assembly.

A fourth alternative embodiment of the invention is shown in FIG. 20. The pallet assembly is generally shown at 320. Like or corresponding parts are indicated with like reference numerals offset by 300. This fourth alternative embodiment is similar to the third alternative embodiment in that the left 338 and right 340 fork tubes and bridges 272 are all integrally formed as a monolithic unit. This embodiment, however, does not enable four-way access for fork tines 24 (FIG. 2). That is to say, the fork tube risers 338, 340 do not include outer or inner windows to enable fork tine 24 access from the sides. As a result, it can be expected that the fourth alternative embodiment will provide increased load carrying capacity. Another distinction in this fourth alternative embodiment, compared to the third alternative embodiment, is the omission of intermediate risers, which would have the result of reducing overall weight of the pallet assembly 320. As in all of the preceding embodiments, the outer angles LO/RO (not indicated in FIG. 20) are asymmetric with respect to their counterpart inner angles LI/RI (also not indicated in FIG. 20). And, the outer angles LO/RO are each greater than their counterpart inner angles LI/RI.

Figure 21:
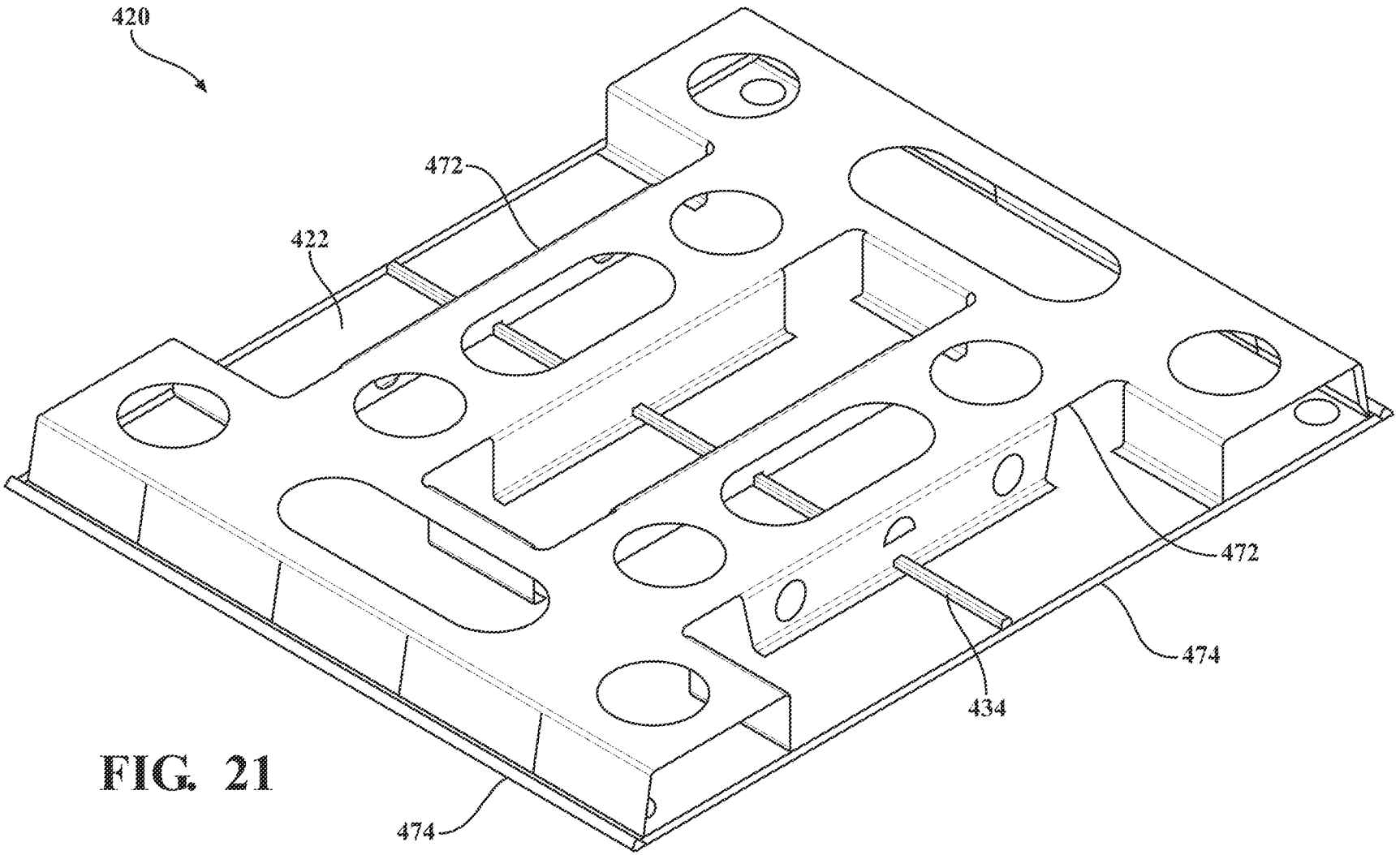
FIG. 21 is a perspective view of the undercarriage features of a fifth alternative embodiment of the pallet assembly.
Figure 22:
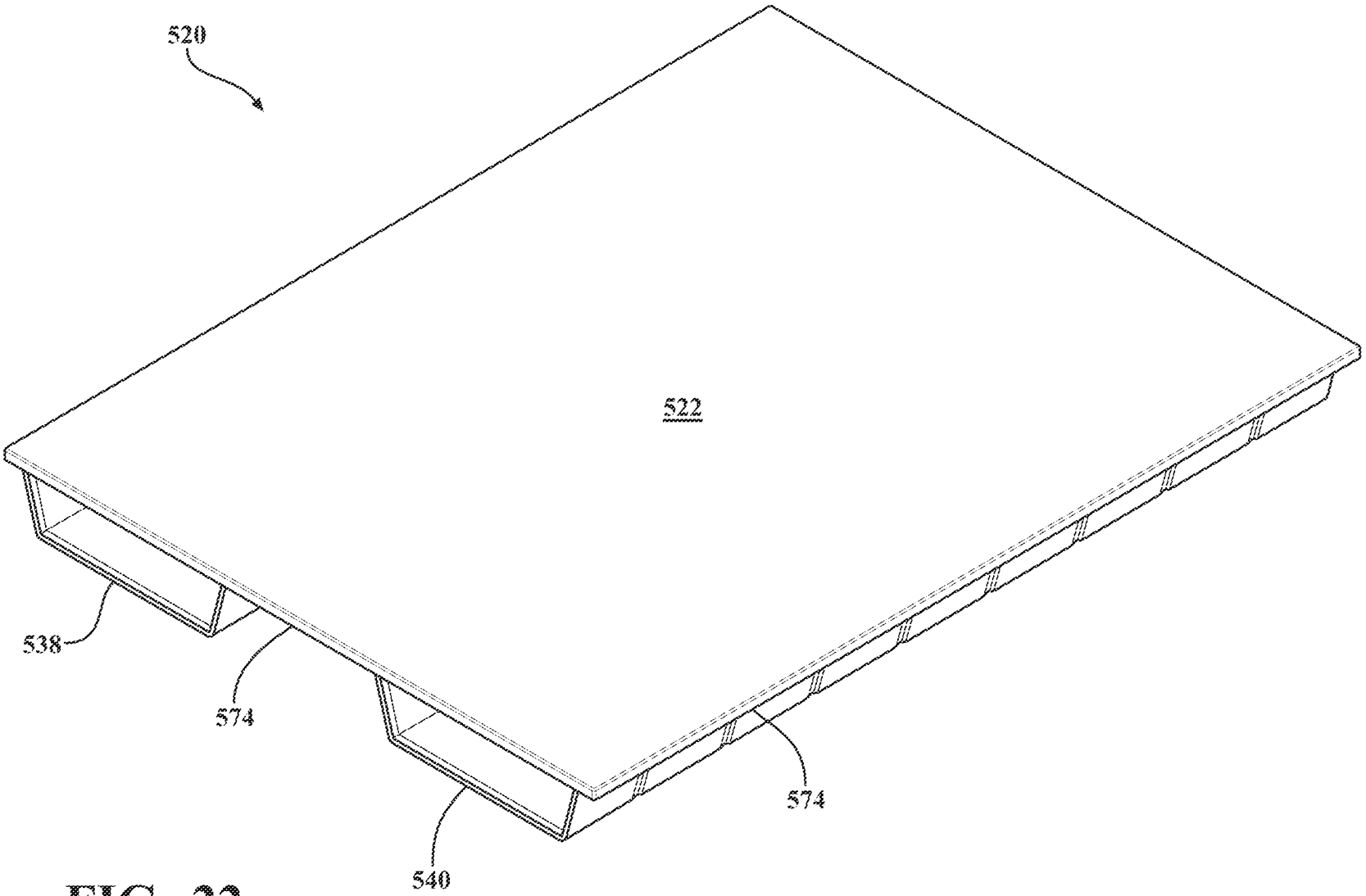
FIG. 22 is a perspective view from the top of a sixth alternative embodiment of the pallet assembly.
Figure 23:
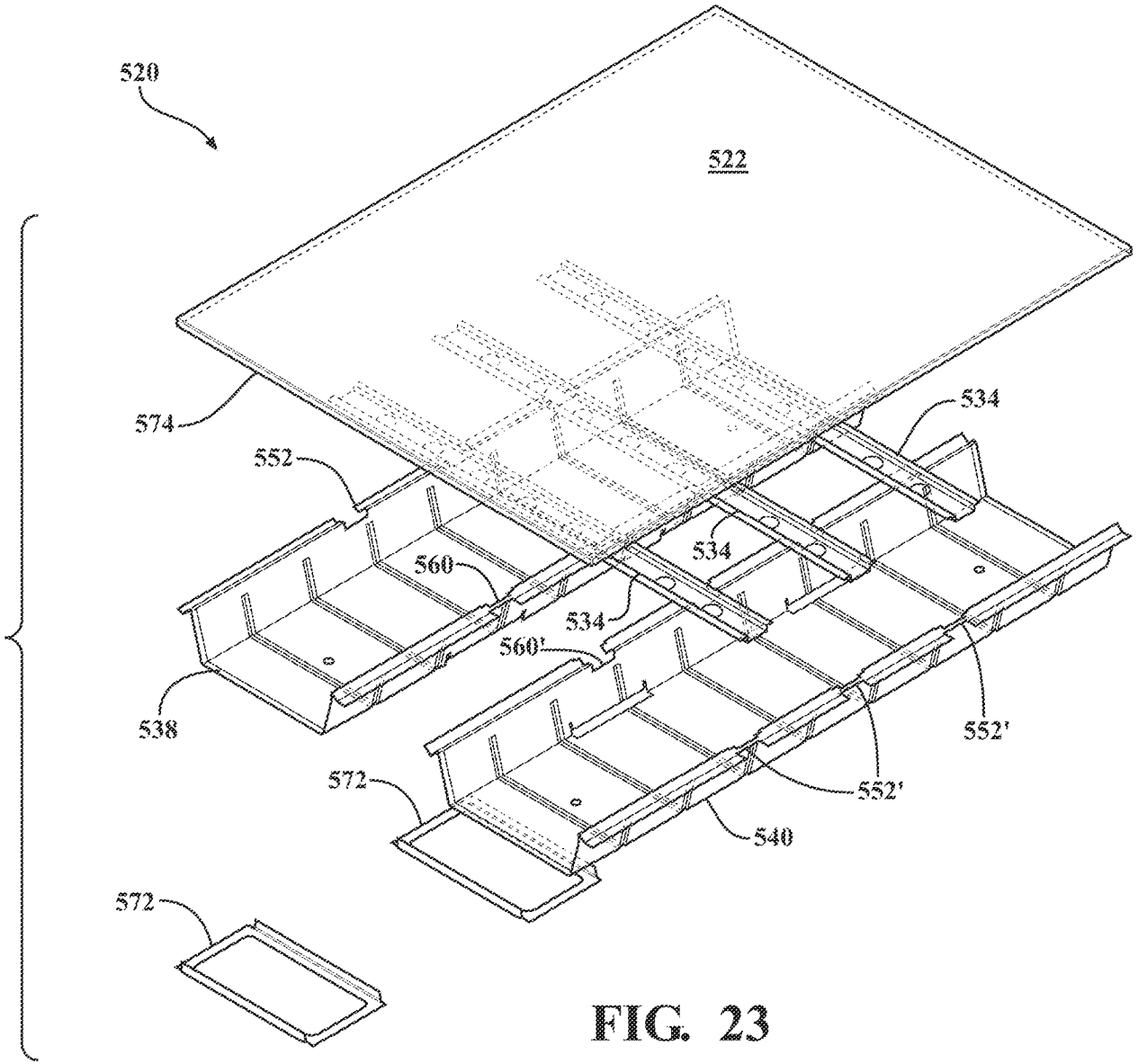
FIG. 23 is an exploded view of the sixth alternative embodiment.
Figure 24:
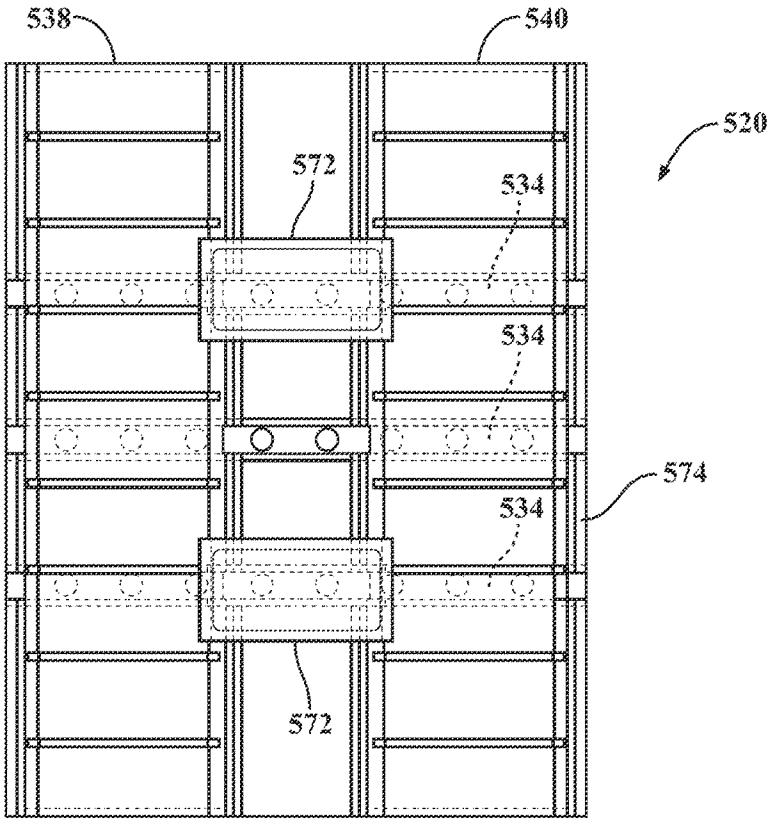
FIG. 24 is a bottom plan view of the sixth alternative embodiment.
Figure 26:
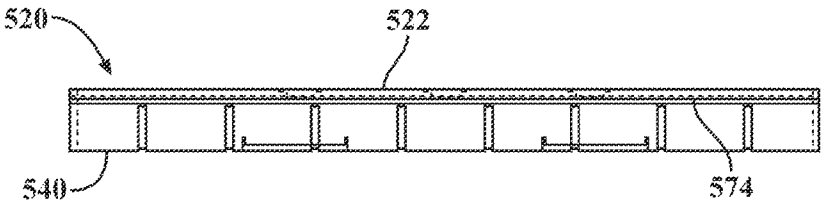
FIG. 26 is a side view of the sixth alternative embodiment as taken generally along lines 26-26 of FIG. 24.
Figure 25:
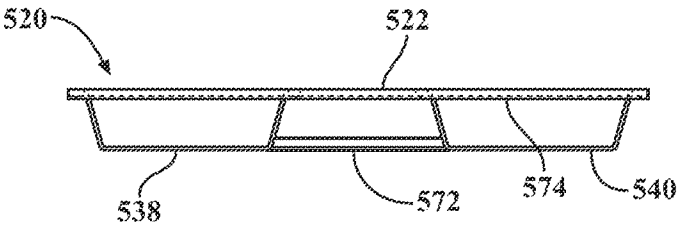
FIG. 25 is an end view of the sixth alternative embodiment as taken generally along lines 25-25 of FIG. 24.

A fifth alternative embodiment of the invention is shown in FIG. 21. The pallet assembly is generally shown at 420. Like or corresponding parts are indicated with like reference numerals offset by 400. This fifth alternative embodiment is similar in many respects to the third alternative embodiment (FIGS. 16-19). One notable distinction is that, in this fifth alternative embodiment, a single supplemental reinforcement rib 434 runs longitudinally below the deck 422. (The reinforcement rib 234 of FIGS. 16-19 runs transversely.) The solitary, longitudinally extending reinforcement rib 434 of FIG. 20 is in direct engagement with the bottom surface of the deck 422 as is common with the reinforcement ribs in the preceding embodiments. The reinforcement rib 434 is a loose-piece member, that may take the form of rectangular tube stock or any other suitable configuration. Notch-like interruptions in the bridges 472 serve as cradles for the reinforcement rib 434. In this embodiment, the deck 422 has a smooth, flat, uninterrupted upper surface. The perimeter under-girding in this example comprises a perimeter frame 474 integrally formed in the deck 422 by under-curling a hollow square edge to add stiffness and structural integrity. Moreover, rigid connection of the reinforcement rib 434, deck 422 and bridges 472 can be accomplished by welding and/or mechanical interlock and/or other suitable fixation technique(s).

A sixth alternative embodiment of the invention is shown in FIGS. 22-26, where the pallet assembly is generally shown at 520. Like or corresponding parts are indicated with like reference numerals offset by 500. This sixth alternative embodiment is similar in several respects to the second alternative embodiment (FIGS. 14-15). As in the second alternative embodiment, bridges 572 extend between the left fork tube riser 538 and the right fork tube riser 540, and together these elements comprise the undercarriage features of the pallet assembly 520. And as was shown in several of the preceding embodiments, the deck 522 has a smooth, flat, uninterrupted upper surface. The perimeter under-girding takes the form of a perimeter frame 574 integrally formed in the deck 522 by under-curling a hollow square edge to add stiffness and structural integrity.

Distinguishing aspects of this sixth embodiment from the design shown in FIGS. 14-15 include three (3) transversely extending reinforcement ribs 534 that each take the form of wide U-shapes channels. Each reinforcement rib 534 is set against the bottom side of the deck 522, inside the perimeter its frame 574. Notch-like interruptions 552, 552', 560, 560' in the left and right fork tube risers 538, 540 serve as individual cradles for the reinforcement ribs 534. Rigid connection of the reinforcement ribs 534, deck 522 and left and right fork tube risers 538, 540 can be accomplished by welding and/or mechanical interlock and/or other suitable fixation technique(s). The wide horizontal base of each reinforcement rib 534 is shown including an array of holes to reduce weight.

Like the fourth alternative embodiment (FIG. 20), this sixth alternative embodiment does not enable four-way access for fork tines 24 (FIG. 2). That is to say, the fork tube risers 538, 540 do not include outer or inner windows that would enable fork tine 24 access from the side. Another distinctive aspect of this sixth alternative embodiment is that the outer angles LO/RO (not indicated in FIGS. 22-26) are symmetrical with respect to their counterpart inner angles LI/RI (also not indicated in FIGS. 22-26). And the outer angles LO/RO are each generally equal to their counterpart inner angles LI/RI. Because fork tines 24 do not access the side of the pallet assembly 520, there is a diminished need to resist racking forces. As such, the asymmetric configurations of the left and right fork tube risers common in preceding embodiments can be substituted for a simple symmetric configuration.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A sheet metal pallet assembly comprising:

a deck having a top surface and a bottom surface, said deck having left and right longitudinal edges, said deck having first and second transverse edges, said left and right longitudinal edges defining a longitudinal direction of said assembly and a length of said deck, perimeter under-girding disposed along said bottom surface of said deck adjacent each of said left and right longitudinal edges and said first and second transverse edges, at least one reinforcement rib in direct engagement with said bottom surface said deck and directly connected to said perimeter girding, a left fork tube riser disposed below said bottom surface of said deck adjacent said left longitudinal edge, said left fork tube riser extending generally the length of said deck between said first and second transverse edges, said left fork tube riser having a left inner leg and a left outer leg, said left fork tube riser having a left floor interconnecting said left inner and outer legs, said left outer leg having an upper edge in direct contact with said bottom surface of said deck, said left outer leg having a left outer interface in direct contact with said left floor, said left inner leg having an upper edge, said interior longitudinal girding being disposed along said upper edge of said left inner leg, said left inner leg having a left inner interface in direct contact with said left floor, a right fork tube riser disposed below said bottom surface of said deck adjacent said right longitudinal edge, said right fork tube riser extending generally the length of said deck between said first and second transverse edges, said right fork tube riser having a right inner leg and a right outer leg, said right fork tube riser having a right floor interconnecting said right inner and outer legs, said right outer leg having an upper edge in direct contact with said bottom surface of said deck, said right outer leg having a right outer interface in direct contact with said right floor, said right inner leg having an upper edge, said interior longitudinal girding being disposed along said upper edge of said right inner leg, said right inner leg having a right inner interface in direct contact with said right floor, and at least one bridge extending between said left floor of said left fork tube riser and said right floor of said right fork tube riser.

2. The assembly of claim 1, wherein said bridge has a body generally co-planar with said left floor and said right floor, a pair of flanges disposed along opposite sides of said body, said flanges extending transversely between said left inner leg and said right inner leg.

3. The assembly of claim 2, wherein said body of said bridge includes a lightening aperture.

4. The assembly of claim 1, wherein said at least one bridge comprises a pair of bridges spaced apart from one another and each extending between said left floor of said left fork tube riser and said right floor of said right fork tube riser.

5. The assembly of claim 1, wherein the end of said left fork tube riser adjacent said first transverse edge comprises a first left end, and the end of said left fork tube riser adjacent said second transverse edge comprised a second left end, and the end of said right fork tube riser adjacent said first transverse edge comprises a first right end, and the end of said right fork tube riser adjacent said second transverse edge comprises a second right end, at least one of said first left end and second left end and first right end and second right end including a fold-over hem.

6. The assembly of claim 1, wherein said deck is generally rectangular in shape with said first and second transverse edges perpendicularly adjoining opposite ends of said left and right longitudinal edges, said left floor being generally parallel to said deck, and said right floor being generally parallel to said deck.

7. The assembly of claim 6, wherein said top surface of said deck is generally flat and without interruptions.

8. The assembly of claim 1, wherein said perimeter under-girding includes a square tubular cross-section.

9. The assembly of claim 8, wherein said tubular cross-section of said perimeter under-girding is integrally formed with said deck.

10. The assembly of claim 1, wherein said perimeter under-girding includes a triangular tubular cross-section.

11. The assembly of claim 10, wherein said tubular cross-section of said perimeter under-girding is integrally formed with said deck.

12. The assembly of claim 1, wherein said perimeter under-girding includes an integrally formed perimeter frame.

13. The assembly of claim 1, wherein said reinforcement rib has a U-shaped cross-section.

14. The assembly of claim 1, wherein said reinforcement rib has a rectangular cross-section.

15. The assembly of claim 1, wherein said reinforcement rib comprises a tubular member.

16. The assembly of claim 1, wherein said interior longitudinal girding includes an interruption at each intersection with said reinforcement rib.

17. The assembly of claim 16, wherein said interior longitudinal girding comprises a triangular tubular cross-section.

18. The assembly of claim 1, wherein said left outer leg has a pair of outer windows, said left inner leg has a pair of inner windows, said left outer windows being transversely aligned with said left inner windows, said right outer leg having a pair of outer windows, said right inner leg having a pair of inner windows, said right outer windows being transversely aligned with said right inner windows, said left outer windows being transversely aligned with said left inner windows and said right outer windows and said right inner windows.

19. A sheet metal pallet assembly comprising:

a deck having a top surface and a bottom surface, said deck having left and right longitudinal edges, said deck having first and second transverse edges, said left and right longitudinal edges defining a longitudinal direction of said assembly and a length of said deck, perimeter under-girding disposed along said bottom surface of said deck adjacent each of said left and right longitudinal edges and said first and second transverse edges, said perimeter under-girding including an integrally formed perimeter frame, at least one reinforcement rib in direct engagement with said bottom surface said deck and directly connected to said perimeter girding, a left fork tube riser disposed below said bottom surface of said deck adjacent said left longitudinal edge, said left fork tube riser extending generally the length of said deck between said first and second transverse edges, said left fork tube riser having a left inner leg and a left outer leg, said left fork tube riser having a left floor interconnecting said left inner and outer legs, said left outer leg having an upper edge in direct contact with said bottom surface of said deck, said left outer leg having a left outer interface in direct contact with said left floor, said left inner leg having an upper edge, said interior longitudinal girding being disposed along said upper edge of said left inner leg, said left inner leg having a left inner interface in direct contact with said left floor, a right fork tube riser disposed below said bottom surface of said deck adjacent said right longitudinal edge, said right fork tube riser extending generally the length of said deck between said first and second transverse edges, said right fork tube riser having a right inner leg and a right outer leg, said right fork tube riser having a right floor interconnecting said right inner and outer legs, said right outer leg having an upper edge in direct contact with said bottom surface of said deck, said right outer leg having a right outer interface in direct contact with said right floor, said right inner leg having an upper edge, said interior longitudinal girding being disposed along said upper edge of said right inner leg, said right inner leg having a right inner interface in direct contact with said right floor, and a pair of bridges spaced apart from one another and each extending between said left floor of said left fork tube riser and said right floor of said right fork tube riser, each said bridge having a body generally co-planar with said left floor and said right floor, each said bridge having a pair of flanges disposed along opposite sides of said body, said flanges extending transversely between said left inner leg and said right inner leg.

* * * * *